US007201674B2

(12) United States Patent
Ohama et al.

(10) Patent No.: US 7,201,674 B2
(45) Date of Patent: Apr. 10, 2007

(54) GOLF BALL

(75) Inventors: Keiji Ohama, Kobe (JP); Takashi Sasaki, Kobe (JP); Takahiro Sajima, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 0 days.

(21) Appl. No.: 11/234,262

(22) Filed: Sep. 26, 2005

(65) Prior Publication Data

US 2006/0116220 A1 Jun. 1, 2006

(30) Foreign Application Priority Data

Dec. 1, 2004 (JP) ..... 2004-348477

(51) Int. Cl.
*A63B 37/14* (2006.01)

(52) U.S. Cl. ..... 473/383

(58) Field of Classification Search ..... 473/383–384
See application file for complete search history.

(56) References Cited

U.S. PATENT DOCUMENTS 5,338,039 A 8/1994 Oka et al.
5,735,757 A 4/1998 Moriyama
6,213,896 B1 4/2001 Higuchi et al.
6,299,551 B1 10/2001 Higuchi et al.
6,599,204 B2 * 7/2003 Kasashima et al. ..... 473/383
6,899,643 B2 * 5/2005 Sajima et al. ..... 473/383
6,951,520 B2 * 10/2005 Ohama et al. ..... 473/383
2002/0173380 A1 11/2002 Ohama et al.
2003/0040378 A1 2/2003 Endo et al.
2003/0153403 A1 8/2003 Endo et al.
2004/0142771 A1 7/2004 Sajima et al.
2006/0154749 A1 * 7/2006 Ohama et al. ..... 473/378

* cited by examiner

*Primary Examiner*—Raeann Gorden
(74) *Attorney, Agent, or Firm*—Birch, Stewart, Kolasch & Birch, LLP

(57) ABSTRACT

Golf ball 2 has a core 4, a mid layer 5 and a cover 6. This mid layer 5 includes 20 parts by weight or greater and 60 parts by weight or less of a styrene block-containing thermoplastic elastomer having a material hardness of less than 10, and 40 parts by weight or greater and 80 parts by weight or less of an ethylene-(meth)acrylic acid copolymer-based ionomer resin having a material hardness of 50 or greater and 70 or less. This mid layer 5 has a hardness of 35 or greater and 50 or less, and a thickness of equal to or less than 1.2 mm. The golf ball 2 has numerous double radius dimples and numerous triple radius dimples on the surface thereof. Proportion of the double radius dimples is 20% or greater and 42% or less, and proportion of triple radius dimples is equal to or greater than 50%.

7 Claims, 12 Drawing Sheets

GOLF BALL

This application claims priority on Patent Application No. 2004-348477 filed in JAPAN on Dec. 1, 2004. The entire contents of this Japanese Patent Application are hereby incorporated by reference.

BACKGROUND OF THE INVENTION

1. Field of the Invention

The present invention relates to golf balls. More particularly, the present invention relates to solid golf balls having a core, a mid layer and a cover.

2. Description of the Related Art

In recent years, three-piece golf balls were developed in attempts to accomplish a feel at impact that is comparative to wound balls, and have been supplied on the market. U.S. Pat. No. 6,299,551 and U.S. Pat. No. 6,213,896 disclose three-piece golf balls having a mid layer that includes a thermoplastic elastomer. U.S. 2002/173380 and U.S. 2003/040378 disclose three-piece golf balls having a mid layer that includes an ionomer resin and a thermoplastic elastomer.

Golf balls have numerous dimples on the surface thereof. In general, golf balls have single radius dimples having a cross-sectional shape with single curvature radius, or double radius dimples having a cross-sectional shape with two curvature radii. The dimples disrupt the air flow around the golf ball during flight to cause turbulent flow separation. By causing the turbulent flow separation, separating points of the air from the golf ball shift backwards leading to the reduction of a drag. The turbulent flow separation promotes the differentia between the separating point on the upper side and the separating point on the lower side of the golf ball, which result from the backspin, thereby enhancing the lift force that acts upon the golf ball. Such a role of the dimples is referred to as a "dimple effect". Excellent dimples disturb the air flow more efficiently.

A variety of proposals with respect to the shape of the dimples in attempts to improve flight performances have been made. U.S. Pat. No. 5,338,039 discloses dimples having a shape with the gradient of a slope disposed in the vicinity of the edge being greater than that of a slope at the bottom part. U.S. Pat. No. 5,735,757 discloses dimples having a cross-sectional shape given by double radius. U.S. 2004/142771 discloses dimples having a great ratio of the curvature radius of the bottom part to the curvature radius in the vicinity of the edge. U.S. 2003/153403 discloses a golf ball having a mid layer including an ionomer resin and a thermoplastic elastomer, and having dimples with a great contour length.

According to the golf balls disclosed in U.S. Pat. No. 6,299,551 and U.S. Pat. No. 6,213,896, resilience performance of the mid layer is insufficient. The flight performance correlates to the resilience performance. Therefore, these golf balls are inferior in the flight performance. According to these golf balls, the flight performance is sacrificed for the sake of the feel at impact.

According to the golf ball disclosed in U.S. 2002/173380, spin at shots with a driver tends to be excessive resulting from high hardness of the mid layer. Excessive spin contributes to insufficient flight distance. The mid layer with high hardness also adversely affects the feel at impact. According to the golf ball disclosed in U.S. 2003/040378, sufficient flight distance is not attained also due to excessive spin.

Top concern to golf players for golf balls is the flight distance. In light of the flight distance, there remains room for improvement of the dimple. When a golf ball is hit with a short iron, the surface thereof may be scuffed. In case of golf balls having double radius dimples, in particular, margin of the dimple is liable to be scuffed resulting from concentration of the stress. There also remains room for improvement of the dimple in respect of the scuff resistance.

An object of the present invention is to provide a golf ball that is excellent in the feel at impact, flight performance and scuff resistance.

SUMMARY OF THE INVENTION

Golf ball according to the present invention has a core, a mid layer and a cover. This mid layer comprises 20% by weight or greater and 60% by weight or less of a styrene block-containing thermoplastic elastomer having a material hardness of less than 10, and 40% by weight or greater and 80% by weight or less of an ethylene-(meth)acrylic acid copolymer-based ionomer resin having a material hardness of 50 or greater and 70 or less. This mid layer has a hardness of 35 or greater and 50 or less, and a thickness of equal to or less than 1.2 mm. This cover has a hardness of equal to or greater than 55, and a thickness of equal to or less than 1.5 mm. This golf ball has numerous double radius dimples and numerous triple radius dimples on the surface thereof. This double radius dimple has a first side wall face having a curvature radius R1, and a bottom face having a curvature radius R2 that is 5 times or more and 55 times or less greater than the curvature radius R1 and being positioned on the bottom side than the first side wall face. This triple radius dimple has a first side wall face having a curvature radius R1 that is equal to or greater than the phantom curvature radius Rx, a second side wall face being positioned on the bottom side than the first side wall face and having a curvature radius R2 that is smaller than the phantom curvature radius Rx, and a bottom face being positioned on the bottom side than the second side wall face and having a curvature radius R3 that is equal to or greater than the phantom curvature radius Rx. Proportion of the number of the double radius dimples in total number of the dimples is 20% or greater and 42% or less. Proportion of the number of the triple radius dimples in total number of the, dimples is equal to or greater than 50%. In the invention, the phantom curvature radius Rx means a curvature radius of a phantom dimple. This phantom dimple means a single radius dimple having an equal diameter to the diameter of the dimple, and an equal volume to the volume of the dimple.

In the mid layer of this golf ball, a soft styrene block-containing thermoplastic elastomer and a hard ethylene-(meth)acrylic acid copolymer-based ionomer resin are used in combination, and the mid layer has a small thickness. This mid layer is responsible for favorable feel at impact and excellent resilience performance. As described above, the double radius dimple is excellent in flight performance, however, it is inferior in scuff resistance. In the golf ball according to the present invention, scuff resistance is compensated by the triple radius dimple. In this golf ball, presence of the double radius dimple and the triple radius dimple admixed improves the aerodynamic characteristic of the golf ball. Owing to synergistic effect of the excellent resilience performance and the excellent aerodynamic characteristic, this golf ball achieves extremely excellent flight performance. This golf ball is excellent in all terms of feel at impact, flight performance and scuff resistance.

Preferably, in the double radius dimple, the depth of the first side wall face is 0.20 times or more and 0.70 times or less greater than the depth of the dimple. Preferably, in the double radius dimple, the maximum diameter of the bottom face is 0.60 times or more and 0.95 times or less greater than the diameter of the dimple.

Preferably, in the triple radius dimple, the depth of the first side wall face is 0.10 times or more and 0.50 times or less greater than the depth of the dimple. Preferably, in the triple radius dimple, the maximum diameter of the second side wall face is 0.60 times or more and 0.95 times or less greater than the diameter of the dimple.

Preferably, the first side wall face and the bottom face of the double radius dimple, and the first side wall face, the second side wall face and the bottom face of the triple radius dimple are convex downward.

Preferably, a ratio (Tc/Tm) of the thickness Tc of the cover to the thickness Tm of the mid layer is 1.0 or greater and 2.0 or less.

DESCRIPTION OF THE PREFERRED EMBODIMENTS

The present invention is hereinafter described in detail with appropriate references to the accompanying drawing according to the preferred embodiments of the present invention.

Figure 1:
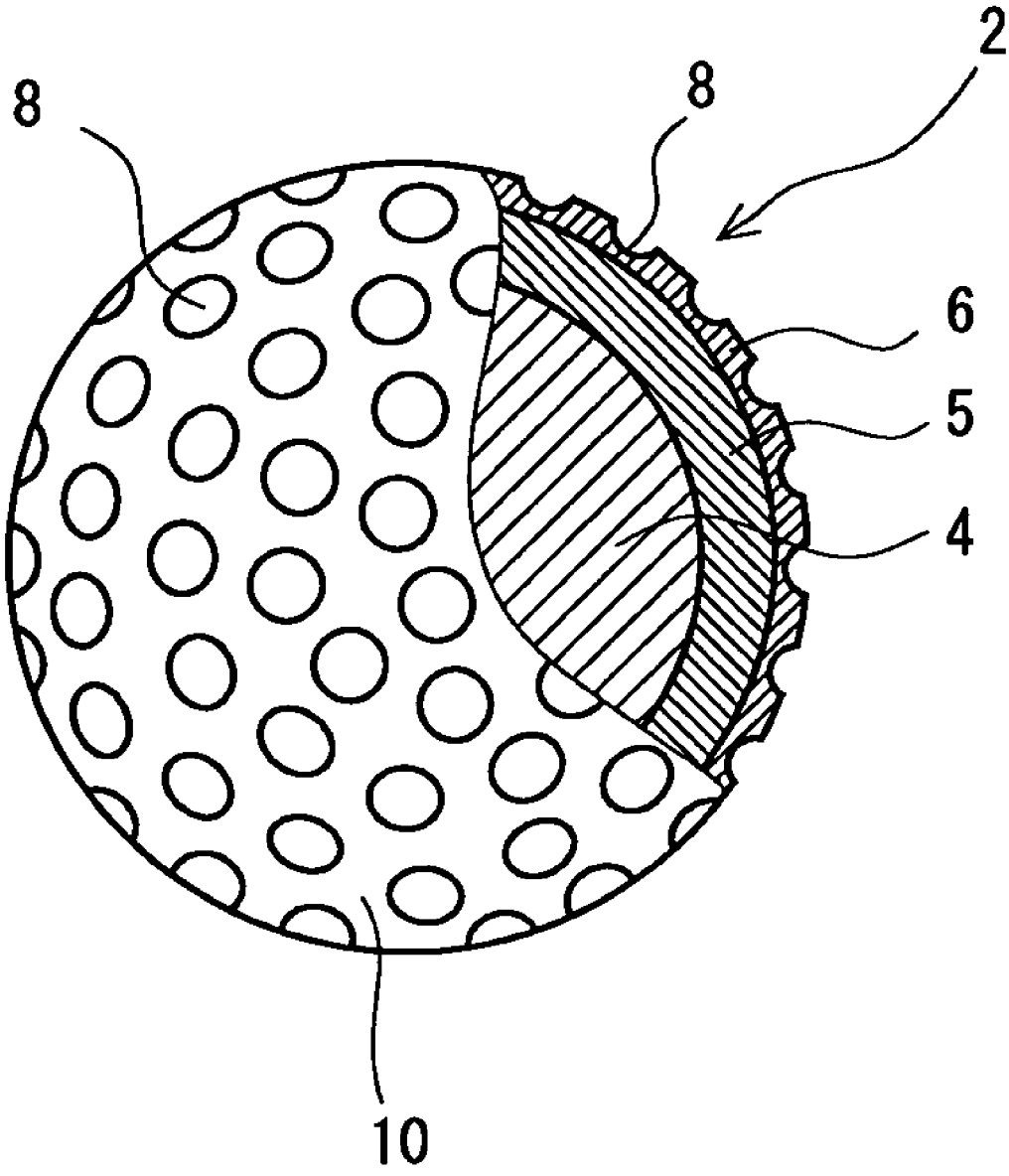
FIG. 1 is a schematic cross-sectional view illustrating a golf ball according to one embodiment of the present invention.

A golf ball 2 illustrated in FIG. 1 has a spherical core 4, a mid layer 5 and a cover 6. Numerous dimples 8 are formed on the surface of the cover 6. Of the surface of the golf ball 2, a part except for the dimples 8 is a land 10. This golf ball 2 has a paint layer and a mark layer to the external side of the cover 6, although these layers are not shown in the Figure. The golf ball 2 may have other layer between the core 4 and the mid layer 5. The golf ball 2 may have other layer between the mid layer 5 and the cover 6.

The cover 6 herein means an outermost layer except for the paint layer and mark layer. Although there exist golf balls referred to as having a cover of a two layered structure, in this instance, the outer layer corresponds to the cover 6 herein.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. Weight of this golf ball 2 is 40 g or greater and 50 g or less. In light of attainment of great inertia, the weight is preferably equal to or greater than 44 g, and particularly preferably equal to or greater than 45.00 g. From the standpoint of conformity to a rule defined by USGA, the weight is preferably equal to or less than 45.93 g.

The core 4 is usually obtained through crosslinking of a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred. When other rubber is used in combination with a polybutadiene, it is preferred that polybutadiene is included as a principal component. Specifically, it is preferred that percentage of polybutadiene in the entire base rubber is equal to or greater than 50% by weight, and particularly equal to or greater than 80% by weight. High cis-polybutadienes having a percentage of cis-1,4 bonds of equal to or greater than 40%, and particularly equal to or greater than 80% are particularly preferred.

For crosslinking of the core 4, a co-crosslinking agent is usually used. Preferable examples of the co-crosslinking agent in light of the resilience performance include monovalent or bivalent metal salts of α,β-unsaturated carboxylic acid having 2 to 8 carbon atoms. Specific examples of preferable co-crosslinking agent include zinc acrylate, magnesium acrylate, zinc methacrylate and magnesium methacrylate. Zinc acrylate is particularly preferred on the grounds that a high resilience performance can be achieved.

As a co-crosslinking agent, also an α,β-unsaturated carboxylic acid having 2 to 8 carbon atoms, and a metal oxide may be blended. Both components react in the rubber composition to give a salt. This salt serves as a co-crosslinking agent. Examples of preferable α,β-unsaturated carboxylic acid include acrylic acid and methacrylic acid, and acrylic acid is particularly preferred. Examples of preferable metal oxide include zinc oxide and magnesium oxide, and zinc oxide is particularly preferred.

The amount of the co-crosslinking agent to be blended is preferably 10 parts by weight or greater and 50 parts by weight or less per 100 parts by weight of the base rubber. When the amount is less than the above range, the resilience performance of the golf ball 2 may become insufficient. In this respect, the amount is more preferably equal to or greater than 15 parts by weight. When the amount is beyond the above range, hard feel at impact of the golf ball 2 may be experienced. In this respect, the amount is particularly preferably equal to or less than 45 parts by weight.

Into the rubber composition for use in the core 4, an organic peroxide may be preferably blended together with the co-crosslinking agent. The organic peroxide is responsible for a crosslinking reaction. By blending the organic peroxide, the resilience performance of the golf ball 2 may be improved. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the organic peroxide to be blended is preferably 0.1 part by weight or greater and 3.0 parts by weight or less per 100 parts by weight of the base rubber. When the amount is less than the above range, the resilience performance of the golf ball 2 may become insufficient. In this respect, the amount is more preferably equal to or greater than 0.3 part by weight, and particularly preferably equal to or greater than 0.5 part by weight. When the amount is beyond the above range, hard feel at impact of the golf ball 2 may be experienced. In this respect, the amount is more preferably equal to or less than 2.8 parts by weight, and particularly preferably equal to or less than 2.5 parts by weight.

Into the core 4 may be blended a filler for the purpose of adjusting specific gravity and the like. Illustrative examples of suitable filler include zinc oxide, barium sulfate, calcium carbonate and magnesium carbonate. Powder of a highly dense metal may be blended as a filler. Specific examples of the highly dense metal include tungsten and molybdenum. The amount of the filler to be blended is determined ad libitum so that the intended specific gravity of the core 4 can be accomplished. Particularly preferable filler is zinc oxide. Zinc oxide also serves as a crosslinking activator. Various kinds of additives such as a sulfur compound, an anti-aging agent, a coloring agent, a plasticizer, a dispersant and the like may be blended at an adequate amount to the core 4 as needed. Into the core 4 may be also blended crosslinked rubber powder or synthetic resin powder.

The core 4 has a diameter of preferably 36 mm or greater and 41 mm or less. When the diameter is less than the above range, the resilience performance of the golf ball 2 may become insufficient. In this respect, the diameter is more preferably equal to or greater than 37 mm. When the diameter is beyond the above range, durability of the golf ball 2 may become insufficient. In this respect, the diameter is more preferably equal to or less than 40 mm.

Amount of compressive deformation of the core 4 is preferably 3.5 mm or greater and 6.0 mm or less. When the amount of compressive deformation is less than the above range, insufficient feel at impact of the golf ball 2 may be experienced. In this respect, the amount of compressive deformation is more preferably equal to or greater than 4.0 mm, and particularly preferably equal to or greater than 4.2 mm. When the amount of compressive deformation is beyond than the above range, durability of the golf ball 2 may become insufficient. In this respect, the amount of compressive deformation is more preferably equal to or less than 5.5 mm. Upon measurement of the amount of compressive deformation, a spherical body which is a subject for the measurement (core 4) is first placed on a hard plate made of metal. Next, a cylinder made of metal gradually descends toward the spherical body. The spherical body intervened between the bottom face of the cylinder and the hard plate is deformed. A migration distance of the cylinder, starting from the state in which initial load of 98 N is applied to the spherical body up to the state in which final load of 1274 N is applied thereto is the amount of compressive deformation.

The core preferably has a surface hardness of 40 or greater and 55 or less. When the surface hardness is less than the above range, the resilience performance of the golf ball 2 may become insufficient. In this respect, the surface hardness is more preferably equal to or greater than 45. When the surface hardness is beyond the above range, insufficient feel at impact may be experienced, and insufficient flight distance may be attained due to excessive spin. In this respect, the surface hardness is more preferably equal to or less than 50. For the measurement of the surface hardness, an automated rubber hardness scale which is equipped with a Shore D type spring hardness scale (trade name "P1", available from Koubunshi Keiki Co., Ltd.) is used. This hardness scale is pressed against the surface of the core.

Crosslinking temperature of the core 4 is usually 140° C. or greater and 180° C. or less. The crosslinking times period of the core 4 is usually 10 minutes or longer and 60 minutes or less. Specific gravity of the core 4 is 0.90 or greater and 1.40 or less. The core 4 may have two or more layers.

In the mid layer 5, a styrene block-containing thermoplastic elastomer and an ethylene-(meth)acrylic acid copolymer-based ionomer resin are used through blending.

Examples of the styrene block-containing thermoplastic elastomer include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS and hydrogenated SIBS. Exemplary hydrogenated SBS include styrene-ethylene-butylene-styrene block copolymers (SEBS). Exemplary hydrogenated SIS include styrene-ethylene-propylene-styrene block copolymers (SEPS) Exemplary hydrogenated SIBS include styrene-ethylene-ethylene-propylene-styrene block copolymers (SEEPS).

In the present invention, exemplary styrene block-containing thermoplastic elastomer may include alloys of olefin and one or two or more selected from the group consisting of SBS, SIS, SIBS, SEBS, SEPS and SEEPS and hydrogenated products thereof. Olefin component in these alloys is presumed to be responsible for the improvement of compatibility between the thermoplastic elastomer and the ionomer resin. Use of this alloy may improve the resilience performance of the golf ball 2. Preferably, an olefin having 2 to 10 carbon atoms is used.

Content of the styrene component in the thermoplastic elastomer is preferably 10% by weight or greater and 50% by weight or less. When the content is less than the above range, the resilience performance of the golf ball 2 may become insufficient. In this respect, the content is more preferably equal to or greater than 12% by weight, and particularly preferably equal to or greater than 15% by weight. When the content is beyond the above range, insufficient feel at impact of the golf ball 2 may be experienced. In this respect, the content is more preferably equal to or less than 47% by weight, and particularly preferably equal to or less than 45% by weight.

In this mid layer 5, a styrene block-containing thermoplastic elastomer having a material hardness of less than 10 is used. This styrene block-containing thermoplastic elastomer is responsible for the resilience performance of the golf ball 2. In light of the resilience performance, the material hardness of the styrene block-containing thermoplastic elastomer is more preferably less than 8, and particularly preferably less than 6. The material hardness is usually equal to or greater than 2. The term "hardness" herein means, unless otherwise noted, the hardness measured in accordance with a standard of "ASTM-D 2240-68". The measurement is carried out with an automated rubber hardness scale which is equipped with a Shore D type spring hardness scale (trade name "P1", available from Koubunshi Keiki Co., Ltd.). For the measurement, a sheet which is formed by hot press is used having a thickness of about 2 mm and consisting of the polymer or the polymer composition. Prior to the measurement, the sheet is stored at a temperature of 23° C. for two weeks. Upon the measurement, three sheets are overlaid. According to the present invention, the material hardness means a hardness of a slab consisting of the polymer alone. For a reference, the material hardness of the styrene block-containing thermoplastic elastomer measured in accordance with "JIS K6301" with a type A hardness scale is preferably less than 80, more preferably less than 60, and particularly preferably less than 40.

Specific examples of the styrene block-containing thermoplastic elastomer having a material hardness of less than 10 include "Rabalon® T3339C", a trade name by Mitsubishi Chemical Corporation.

The ethylene-(meth)acrylic acid copolymer-based ionomer resin is obtained by the copolymerization of ethylene and acrylic acid or methacrylic acid. This ionomer resin generally contains 70% by weight or greater and 95% by weight or less of an ethylene component, and 5% by weight or greater and 30% by weight or less of an acrylate component or a methacrylate component. A part of carboxylic acid in the copolymer is neutralized by a metal ion. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ion in light of the resilience performance and durability of the golf ball 2 is sodium ion, zinc ion, lithium ion and magnesium ion.

In this mid layer 5, the ethylene-(meth)acrylic acid copolymer-based ionomer resin having a material hardness of 50 or greater and 70 or less is used. When the material hardness is less than the above range, the resilience performance of the golf ball 2 may become insufficient. In this respect, the material hardness is more preferably equal to or greater than 53, and particularly preferably equal to or greater than 55. When the material hardness is beyond the above range, unfavorable feel at impact of the golf ball 2 may be experienced, and the spin may be excessive. In this respect, the material hardness is more preferably equal to or less than 67, and particularly preferably equal to or less than 65.

Specific examples of the ethylene-(meth)acrylic acid copolymer-based ionomer resin having a material hardness of 50 or greater and 70 or less include "Himilan 1555", "Himilan 1557", "Himilan 1605" and "Himilan 1706", trade names by Du Pont-MITSUI POLYCHEMICALS Co., Ltd.; and "Surlyn® 8945" and "Surlyn® 9945", trade names by Dupont.

Proportion "Pst" of the styrene block-containing thermoplastic elastomer having a material hardness of less than 10 in the mid layer 5 is 20% by weight or greater and 60% by weight or less. Proportion "Pio" of the ethylene-(meth) acrylic acid copolymer-based ionomer resin having a material hardness of 50 or greater and 70 or less in the mid layer 5 is 40% by weight or greater and 80% by weight or less. Excellent compatibility is achieved between the styrene block-containing thermoplastic elastomer having a material hardness of less than 10 and the ethylene-(meth)acrylic acid copolymer-based ionomer resin having a material hardness of 50 or greater and 70 or less. Both components are admixed at the molecular level. This mid layer 5 is excellent in strength and rebound resilience in spite of the low hardness. When the proportion "Pst" of the styrene block-containing thermoplastic elastomer is less than the above range, insufficient feel at impact of the golf ball 2 may be experienced. In this respect, the proportion "Pst" is more preferably equal to or greater than 25% by weight, and particularly preferably equal to or greater than 30% by weight. When the proportion "Pio" of the ethylene-(meth) acrylic acid copolymer-based ionomer resin is less than the above range, the resilience performance of the golf ball 2 may become insufficient. In this respect, the proportion "Pio" is more preferably equal to or greater than 45% by weight, and particularly preferably equal to or greater than 50% by weight.

As the base polymer of the mid layer 5, (A) a styrene block-containing thermoplastic elastomer having a material hardness of less than 10, (B) an ethylene-(meth)acrylic acid copolymer-based ionomer resin having a material hardness of 50 or greater and 70 or less and (C) other polymer may be used. Examples of the other polymer (C) include (C1) styrene block-containing thermoplastic elastomers other than that described in (A) above, (C2) ionomer resins other than that described in (B) above, (C3) thermoplastic polyurethane elastomers, (C4) thermoplastic polyamide elastomers, (C5) thermoplastic polyester elastomers and (C6) thermoplastic polyolefin elastomers.

Specific examples of the styrene block-containing thermoplastic elastomer (C1) other than that described in (A) above include "Epofriend® A1010", a trade name by Daicel Chemical Industries; "Septon HG-252", a trade name by Kuraray Co., Ltd.; and "Rabalon® SJ5400N", "Rabalon® SJ6400N", "Rabalon® SJ7400N", "Rabalon® SJ8400N", "Rabalon® SJ9400N" and "Rabalon® SR04", trade names by Mitsubishi Chemical Corporation.

Specific examples of the ionomer resin (C2) other than that described in (B) above include "Himilan AM7316", a trade name by Du Pont-MITSUI POLYCHEMICAL Co., Ltd.; "Surlyn® 6320", "Surlyn® 8120", "Surlyn® 8320" and "Surlyn® 9320", trade names by Dupont; and "IOTEK 7520", a trade name by Exxon Corporation.

Examples of the thermoplastic polyurethane elastomer (C3) include "Kuramiron 9180" and "Kuramiron 9195", trade names by Kuraray Co., Ltd., and "Elastollan ET880" and "Elastollan ET890", trade names by BASF Polyurethane Elastomers Co., Ltd.

Examples of the thermoplastic polyamide elastomer (C4) include "Pebax 2533", a trade name by Toray Industries, Inc.

Examples of the thermoplastic polyester elastomer (C5) include "Hytrel® 4047", "Hytrel® 4767" and "Hytrel® 5557", trade names by Du Pont-TORAY Co., LTD., and "Primalloy®A1500", a trade name by Mitsubishi Chemical Corporation.

Examples of the thermoplastic polyolefin elastomer (C6) include "Milastomer®M4800NW", a trade name by Mitsui Chemicals, Inc., and "TPE 3682" and "TPE 9455", trade names by Sumitomo Chemical Co., Ltd.

When the other polymer (C) is used in the mid layer 5, the amount to be blended is preferably equal to or less than 10 parts by weight per 100 parts by weight of the entire base polymer. In other words, total amount of the styrene block-containing thermoplastic elastomer (A) having a material hardness of less than 10 and the ethylene-(meth)acrylic acid copolymer-based ionomer resin (B) having a material hardness of 50 or greater and 70 or less is preferably equal to or greater than 90 parts by weight per 100 parts by weight of the entire base polymer.

Into the mid layer 5 may be blended a filler, a dispersant, a coloring agent and the like in an adequate amount as needed. The mid layer 5 may be blended with powder of a highly dense metal such as tungsten, molybdenum or the like for the purpose of adjusting the specific gravity.

The mid layer 5 has a hardness Hm of equal to or less than 50. This mid layer 5 is soft. This mid layer 5 is responsible for the feel at impact of the golf ball 2. According to the golf ball 2 having this mid layer 5, a deformation behavior upon impact with a driver is optimized. Owing to the optimal deformation behavior, initial spin rate is suppressed, thereby elevating the flight distance. In light of the feel at impact and flight performance, the hardness Hm is more preferably equal to or less than 45. In light of the resilience performance of the golf ball 2, the hardness Hm is preferably equal to or greater than 35, and more preferably equal to or greater than 40.

The mid layer 5 has a thickness Tm of equal to or less than 1.2 mm. When the thickness Tm is beyond the above range, the resilience performance of the golf ball 2 may become insufficient. In this respect, the thickness Tm is more preferably equal to or less than 1.1 mm, and particularly preferably equal to or less than 1.0 mm. When the thickness Tm is too small, insufficient feel at impact of the golf ball 2 may be experienced, and the initial spin may be excessive. In this respect, the thickness Tm is preferably equal to or greater than 0.3 mm, and particularly preferably equal to or greater than 0.5 mm.

Examples of base polymer suitable for the cover 6 include ionomer resins, styrene block-containing thermoplastic elastomers, thermoplastic polyurethane elastomers, thermoplastic polyamide elastomers, thermoplastic polyester elastomers and thermoplastic polyolefin elastomers. In light of the resilience performance of the golf ball 2, ionomer resins are preferred. When other polymer is used in combination with the ionomer resin, amount of the ionomer resin to be blended is preferably equal to or greater than 70 parts by weight per 100 parts of the entire base polymer.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 6 may be also blended with powder of a highly dense metal such as tungsten, molybdenum or the like for the purpose of adjusting the specific gravity.

The cover 6 has a hardness Hc of equal to or greater than 55. This cover 6 is softer than the mid layer 5. This cover 6 is responsible for the resilience performance of the golf ball 2. In light of the resilience performance, the hardness Hc is more preferably equal to or greater than 57. In light of the feel at impact of the golf ball 2, the hardness Hc is preferably equal to or less than 70, and more preferably equal to or less than 65.

The cover 6 has a thickness Tc of equal to or less than 1.5 mm. When the thickness Tc is beyond the above range, insufficient feel at impact of the golf ball 2 may be experienced, and the flight performance may become insufficient due to excessive spin. In this respect, the thickness Tc is more preferably equal to or less than 1.4 mm. In light of the resilience performance and durability of the golf ball 2, the thickness Tc is preferably equal to or greater than 0.8 mm.

In light of achievement of both the flight performance and the feel at impact, the difference (Hc−Hm) between the hardness Hc of the cover 6 and the hardness Hm of the mid layer 5 is preferably equal to or greater than 10, and more preferably equal to or greater than 15. The difference (Hc−Hm) is preferably equal to or less than 30.

Ratio (Tc/Tm) of the thickness Tc of the cover 6 to the thickness Tm of the mid layer 5 is preferably 1.0 or greater and 2.0 or less. When the ratio (Tc/Tm) is less than the above range, the resilience performance of the golf ball 2 may become insufficient. In this respect, the ratio (Tc/Tm) is more preferably equal to or greater than 1.2. When the ratio (Tc/Tm) is beyond the-above range, insufficient feel at impact of the golf ball 2 may be experienced, and the initial spin may be excessive. In this respect, the ratio (Tc/Tm) is more preferably equal to or less than 1.8, and particularly preferably equal to or less than 1.6.

Figure 2:
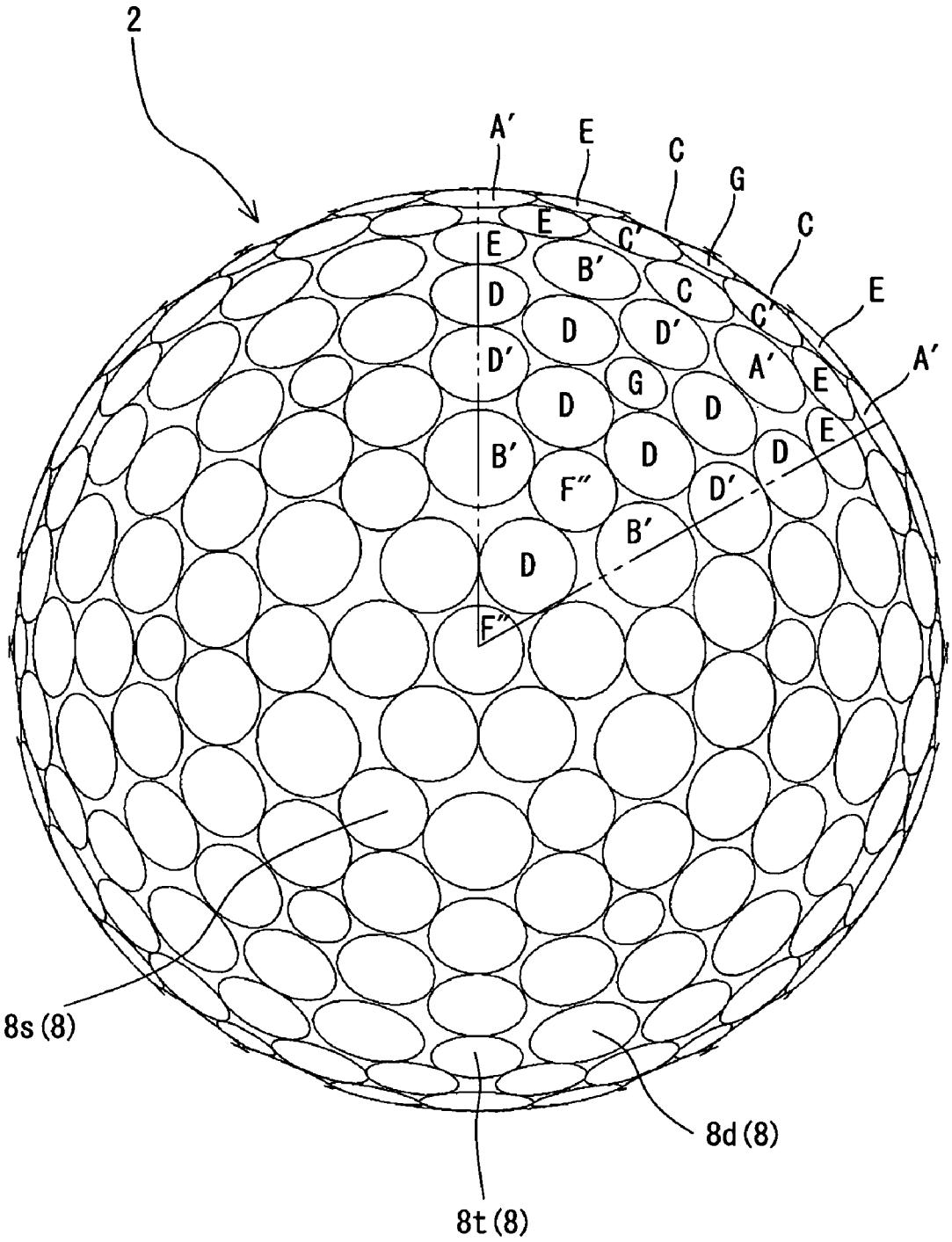
FIG. 2 is an enlarged plan view illustrating the golf ball shown in FIG. 1.
Figure 3:
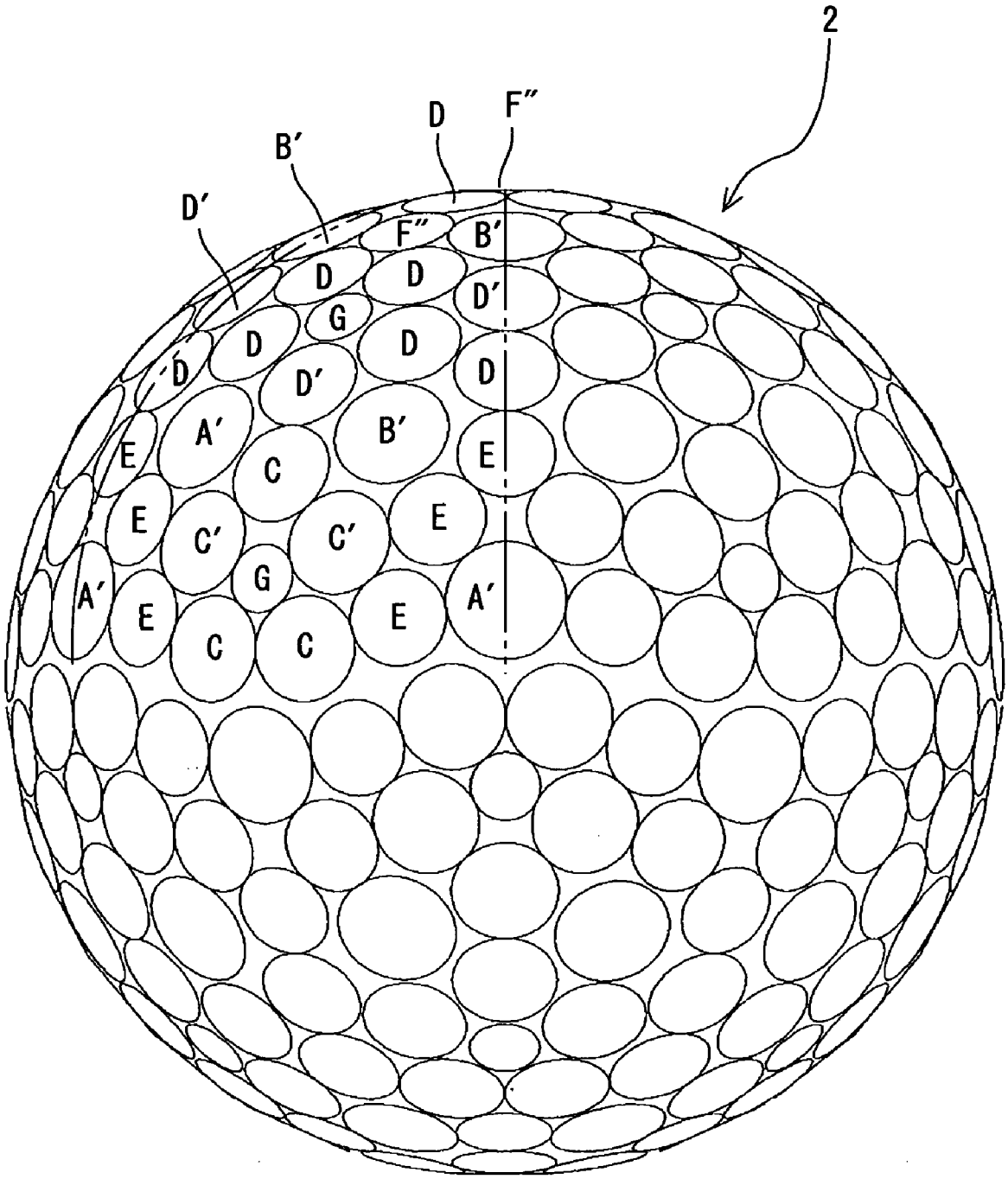
FIG. 3 is a front view illustrating the golf ball shown in FIG. 2.

FIG. 2 is an enlarged plan view illustrating the golf ball 2 shown in FIG. 1; and FIG. 3 is a front view of the same. As is clear from FIG. 2 and FIG. 3, the plane shape of all the dimples 8 is circular. In FIG. 2 and FIG. 3, kinds of the dimples 8 are illustrated by symbols in one unit, provided when the surface of the golf ball 2 is comparted into twelve equivalent units. This golf ball 2 has dimples A' having a diameter of 5.10 mm, dimples B' having a diameter of 5.00 mm, dimples C having a diameter of 4.60 mm, dimples C' having a diameter of 4.60 mm, dimples D having a diameter of 4.50 mm, dimples D' having a diameter of 4.50 mm, dimples E having a diameter of 4.20 mm, dimples F" having a diameter of 4.00 mm, and dimples G having a diameter of 3.00 mm. The number of the dimples A' is 24; the number of the dimples B' is 24; the number of the dimples C is 36; the number of the dimples C' is 24; the number of the dimples D is 72; the number of the dimples D' is 24; the number of the dimples E is 60; the number of the dimples F" is 14; and the number of the dimples G is 24. Total number of the dimples 8 of this golf ball 2 is 302.

The dimples A', B', C' and D' are double radius dimples 8*d*. The dimples C, D, E and G are triple radius dimples 8*t*. The dimple F" is a single radius dimple 8*s*.

Figure 4:
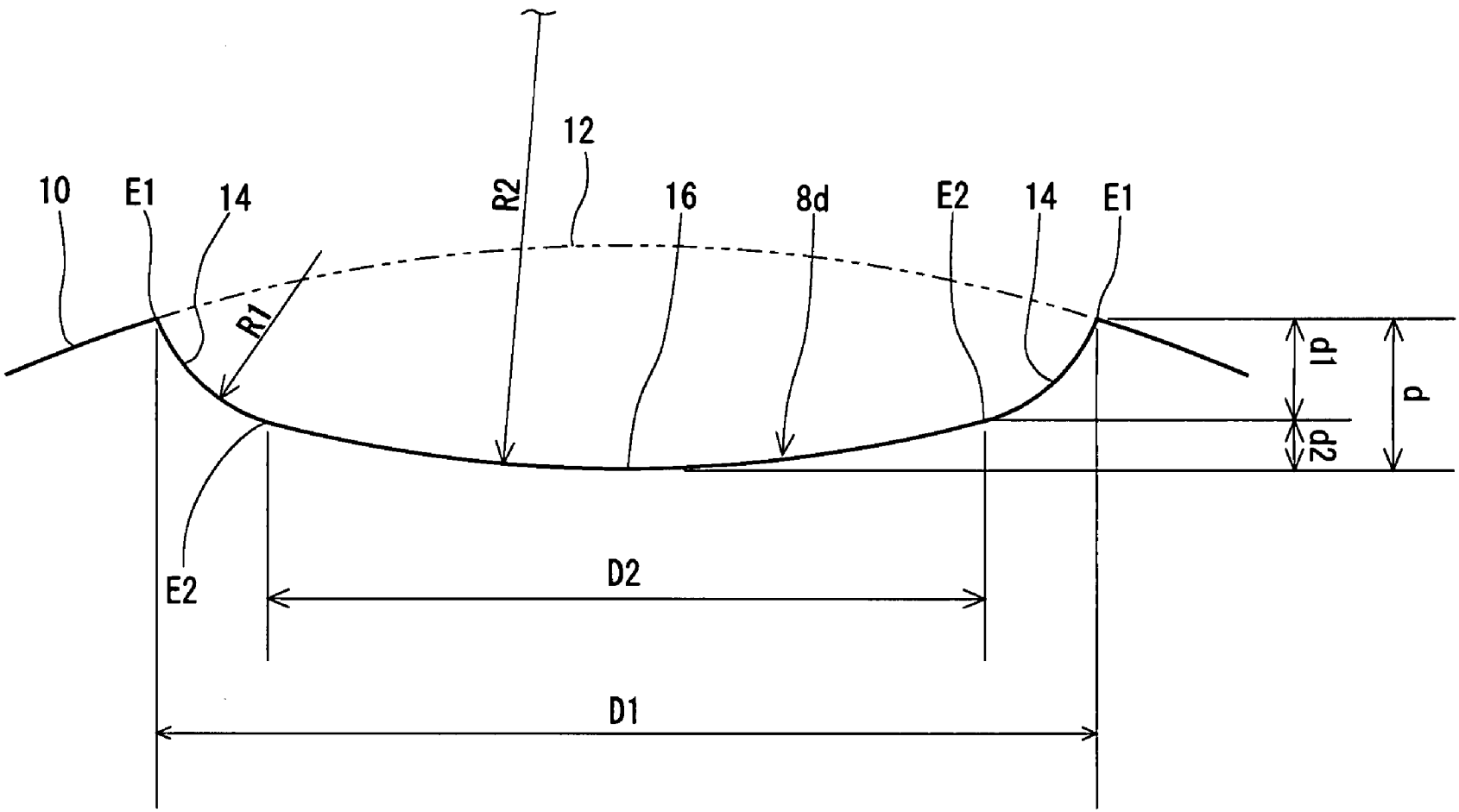
FIG. 4 is an enlarged cross-sectional view illustrating a part of the golf ball shown in FIG. 1.

FIG. 4 is an enlarged cross-sectional view illustrating a part of the golf ball 2 shown in FIG. 1. In this FIG. 4, a double radius dimple 8*d* is illustrated. In this FIG. 4, a cross section along a plane passing through the weighted center of area of the dimple 8*d* and the center of the golf ball 2 is shown. A top-to-bottom direction in FIG. 4 is an in-depth direction of the dimple 8*d*. The in-depth direction is a direction from the weighted center of area of the dimple 8*d* toward the center of the golf ball 2. What is indicated by a chain double-dashed line 12 in FIG. 4 is a phantom sphere. The surface of the phantom sphere 12 corresponds to a surface of the golf ball 2 when it is postulated that there is no dimple present. The dimple 8*d* is recessed from the phantom sphere 12. The land 10 agrees with the phantom sphere 12.

This dimple 8*d* has a first side wall face 14 and a bottom face 16. The first side wall face 14 is ring shaped. The bottom face 16 is bowl-shaped. The first side wall face 14 is continued to the land 10 at a point E1. The point E1 corresponds to the edge of the dimple 8*d*. The edge E1 defines plane shape of the dimple 8*d*. The edge E1 may be rounded. The-bottom face 16 is positioned on the bottom side of the first side wall face 14. The bottom face 16 is continued to the-first side wall face 14 at the point E2. The bottom face 16 is in contact with the first side wall face 14.

What is indicated by a both-oriented arrowhead D1 in FIG. 4 is the diameter of the dimple 8*d*. This diameter DI is also a maximum diameter of the first side wall face 14. What is indicated by a both-oriented arrowhead D2 is a maximum diameter of the bottom face 16. The diameter D1 of the dimple 8*d* is preferably 2.0 mm or greater and 6.0 mm or less. When the diameter D1 is less than the above range, dimple effect may be hardly exerted. In this respect, the diameter D1 is more preferably equal to or greater than 2.2 mm, and particularly preferably equal to or greater than 2.4 mm. When the diameter D1 is beyond the above range, a feature of the golf ball 2 which is substantially a sphere may be compromised. In this respect, the diameter D1 is more preferably equal to or less than 5.8 mm, and particularly preferably equal to or less than 5.6 mm.

The first side wall face 14 is convex downward. Maximum diameter line of the first side wall face 14 passes through the point E1. In other words, the first side wall face 14 does not run off the point E1 outside in the horizontal direction. Accordingly, accumulation of the air is prevented. The undermost point of the first side wall face 14 agrees with the point E2. In other words, the first side wall face 14 inclines downward from the point E1 to the point E2. Accordingly, accumulation of the air is-prevented.

The bottom face 16 is convex downward. Maximum diameter line of the bottom face 16 passes through the point E2. In other words, the bottom face 16 does not run off the point E2 outside in the horizontal direction. Accordingly, accumulation of the air is prevented.

What is indicated by an arrowhead R1 in FIG. 4 is the curvature radius of the first side wall face 14, and what is indicated by an arrowhead R2 is a curvature radius of the bottom face 16. The curvature radius R2 is greater than the curvature radius R1. In other words, first side wall face 14 is a steep slope, while the bottom face 16 is a gentle slope. In this dimple 8*d*, the ratio (R2/R1) is equal to or greater than 5. This ratio (R2/R1) is greater than the ratio (R2/R1) of conventional double radius dimples. This dimple 8*d* is responsible for the flight performance of the golf ball 2. Although grounds for contribution of this dimple 8*d* to the flight performance of the golf ball 2 is uncertain in detail, it is speculated that air flow from the land 10 toward the deepest place is disrupted due to great ratio (R2/R1), thereby the drag being reduced. In light of the flight performance, the ratio (R2/R1) is more preferably equal to or greater than 10, and particularly preferably equal to or greater than 20. When the ratio (R2/R1) is too great, the air flow on the bottom face 16 becomes monotonous, therefore, the ratio (R2/R1) is preferably equal to or less than 55, and more preferably equal to or less than 50. The curvature radius R1 is preferably 0.3 mm or greater and 10.0 mm or less. The curvature radius R2 is preferably 2.0 mm or greater and 60.0 mm or less.

Maximum diameter D2 of the bottom face 16 is preferably 0.60 times or more and 0.95 times or less greater than the diameter D1 of the dimple 8*d*. When the diameter D2 is less than the above range, contributing rate of the bottom face 16 to the dimple effect may become insufficient. In this respect, the diameter D2 is more preferably equal to or more than 0.70 times, and particularly preferably equal to or more than 0.75 times greater than the diameter D1. When the diameter D2 is beyond the above range, contributing rate of first side wall face 14 to the dimple effect may become insufficient. In this respect, the diameter D2 is more preferably equal to or less than 0.93 times, and particularly preferably equal to or less than 0.90 times greater than the diameter D1.

What is indicated by a both-oriented arrowhead d1 in FIG. 4 is the depth of the first side wall face 14; what is indicated by a both-oriented arrowhead d2 is the depth of the bottom face 16. Sum total of the depth d1 and the depth d2 is the depth d of the dimple 8*d*.

The depth d1 of the first side wall face 14 is preferably 0.20 times or more and 0.70 times or less greater than the depth d of the dimple 8*d*. When the depth d1 is less than the above range, contributing rate of the first side wall face 14 to the dimple effect may become insufficient. In this respect, the depth d1 is more preferably equal to or more than 0.22 times, and particularly preferably equal to or more than 0.25 times greater than the depth d. When the depth d1 is beyond the above range, contributing rate of the bottom face 16 to the dimple effect may become insufficient. In this respect, the depth d1 is more preferably equal to or less than 0.68 times, and particularly preferably equal to or less than 0.65 times greater than the depth d.

Figure 5:
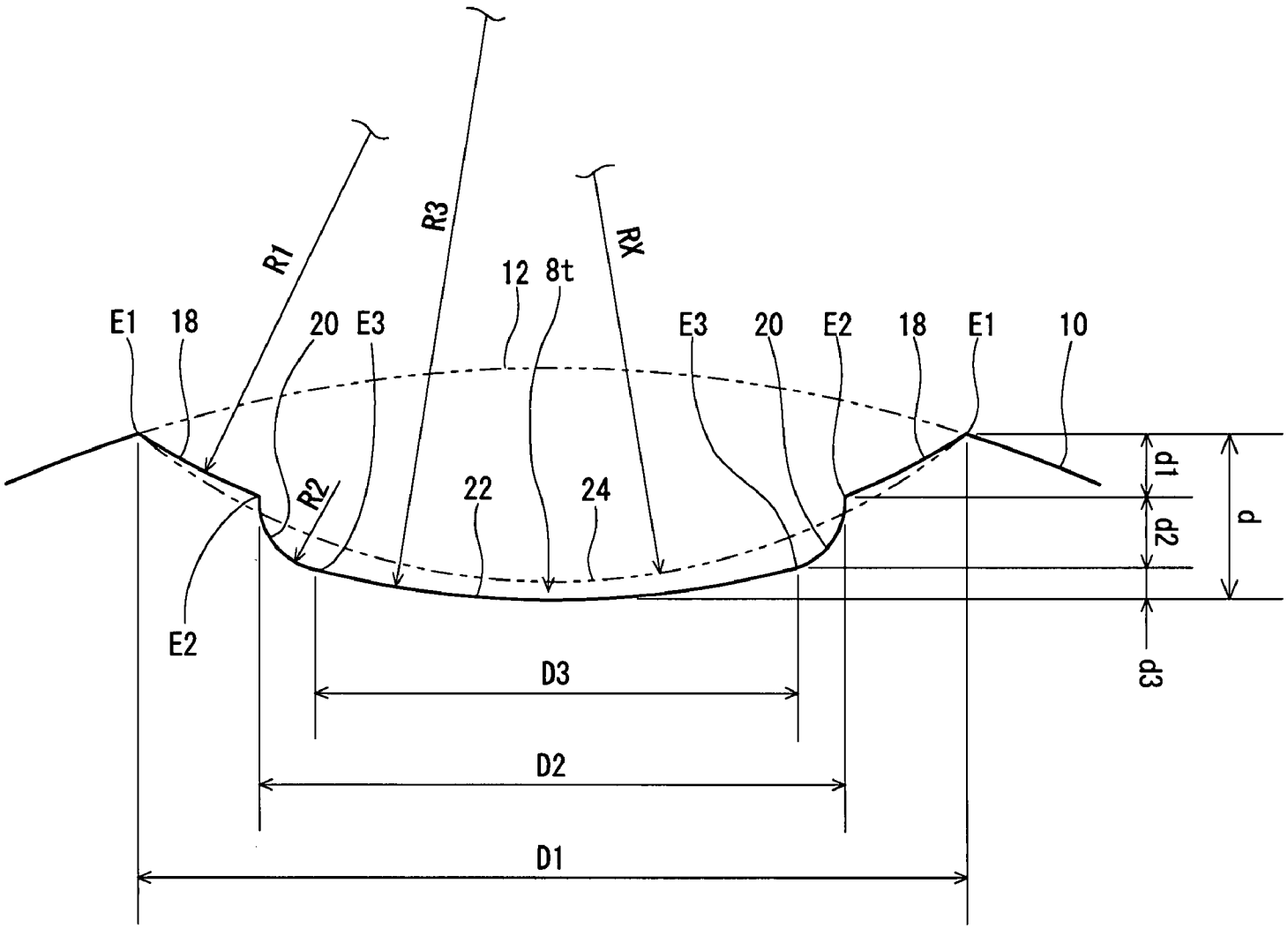
FIG. 5 is an enlarged cross-sectional view illustrating a part of the golf ball shown in FIG. 1.

FIG. 5 is an enlarged cross-sectional view illustrating a part of the golf ball 2 shown in FIG. 1. In this FIG. 5, a triple radius dimple 8*t* is illustrated. This dimple 8*t* has a first side wall face 18, a second side wall face 20 and a bottom face 22. The first side wall face 18 and second side wall face 20 are ring shaped. The bottom face 22 is bowel shaped. The first side wall face 18 is continued to the land 10 at an edge E1. The edge E1 may be rounded. The second side wall face 20 is positioned on the bottom side of the first side wall face 18. The second side wall face 20 is continued to the first side wall face 18 at the point E2. The edge E2 may be rounded. The bottom face 22 is positioned on the bottom side of the second side wall face 20. The bottom face 22 is continued to the second side wall face 20 at the point E3. The bottom face 22 is in contact with the second side wall face 20.

What is indicated by a both-oriented arrowhead D1 in FIG. 5 is the diameter of the dimple 8*t*. This diameter D1 is also the maximum diameter of the first side wall face 18. What is indicated by the both-oriented arrowhead D2 is the maximum diameter of the second side wall face 20. What is indicated by the both-oriented arrowhead D3 is the maximum diameter of the bottom face 22. The diameter D1 of the dimple 8*t* is preferably 2.0 mm or greater and 6.0 mm or less. When the diameter D1 is less than the above range, dimple effect may be hardly exerted. In this respect, the diameter D1 is more preferably equal to or greater than 2.2 mm, and particularly preferably equal to or greater than 2.4 mm. When the diameter D1 is beyond the above range, a feature of the golf ball 2 which is substantially a sphere may be compromised. In this respect, the diameter D1 is more preferably equal to or less than 5.8 mm, and particularly preferably equal to or less than 5.6 mm.

In FIG. 5, what is indicated by a chain double-dashed line 24 is a phantom dimple. The phantom dimple 24 has a cross-sectional shape of a circular arc. Curvature radius of this circular arc is denoted by a symbol Rx in FIG. 5. This phantom dimple 24 is a single radius dimple. The phantom dimple 24 has a diameter of D1. In other words, the phantom dimple 24 has a diameter that is equal to the diameter of the triple radius dimple 8*t*. The phantom dimple 24 is postulated to have a volume that is equal to the volume of the triple radius dimple 8*t*. The phantom curvature radius Rx is usually 5.0 mm or greater and 25.0 mm or less.

The first side wall face 18 is convex downward. The first side wall face 18 has a curvature radius R1 that is equal to or greater than the phantom curvature radius Rx. In other words, the first side wall face 18 curves gently. The air passed through the land 10 flows along the first side wall face 18. The air flows smoothly from the land 10 toward the center of the dimple 8*t* because the first side wall face 18 has a gentle curve. The first side wall face 18 having a gentle curve moderates the concentration of stress in the vicinity of the edge E1. This triple radius dimple 8*t* prevents the golf ball 2 from the scuffing upon a hit with a short iron. The triple radius dimple 8*t* is responsible for scuff resistance of the golf ball 2. In light of the smooth air flow and scuff resistance, the curvature radius R1 is preferably equal to or greater than 7.0 mm, and particularly preferably equal to or greater than 8.0 mm. The curvature radius R1 is preferably equal to or less than 30.0 mm.

Maximum diameter line of the first side wall face 18 passes through the point E1. In other words, the first side wall face 18 does not run off the point E1 outside in the horizontal direction. Accordingly, accumulation of the air is prevented. The undermost point of the first side wall face 18 agrees with the point E2. In other words, the first side wall face 18 inclines downward from the point E1 to the point E2. Accordingly, accumulation of the air is prevented.

The second side wall face 20 is convex downward. The second side wall face 20 has a curvature radius R2 that is less than the phantom curvature radius Rx. The air passed through the first side wall face 18 flows along the second side wall face 20. Direction of the air is suddenly changed by the second side wall face 20. This change in direction enhances the dimple effect. In light of the dimple effect, the curvature radius R2 is preferably equal to or less than 0.40 times, more preferably equal to or less than 0.30 times, and particularly preferably equal to or less than 0.25 times greater than the phantom curvature radius Rx. The curvature radius R2 is preferably equal to or more than 0.10 times greater than the phantom curvature radius Rx. The curvature radius R2 is preferably 1.5 mm or greater and 5.0 mm or less.

Maximum diameter line of the second side wall face 20 passes through the point E2. In other words, the second side wall face 20 does not run off the point E2 outside in the horizontal direction. Accordingly, accumulation of the air is prevented. The undermost point of the second side wall face 20 agrees with the point E3. In other words, the second side wall face 20 inclines downward from the point E2 to the point E3. Accordingly, accumulation of the air is prevented.

The bottom face 22 is convex downward. The bottom face 22 has a curvature radius R3 that is equal to or greater than the phantom curvature radius Rx. In other words, the bottom face 22 curves gently. The air passed through the second side wall face 20 flows along the bottom face 22. The air is smoothly introduced to the opposite second side wall face 20 by means of this bottom face 22. Direction of the air is suddenly changed by the opposite second side wall face 20. This change in direction enhances the dimple effect. In light of smooth air flow, the curvature radius R3 of the bottom face 22 is preferably equal to or more than 1.10 times, and more preferably equal to or more than 1.20 times greater than the phantom curvature radius Rx. The curvature radius R3 of the bottom face 22 is preferably equal to or less than 1.70 times greater than the phantom curvature radius Rx. The curvature radius R3 is preferably equal to or greater than 7.0 mm, and particularly preferably equal to or greater than 8.0 mm. The curvature radius R3 is preferably equal to or less than 35.0 mm.

Maximum diameter line of the bottom face 22 passes through the point E3. In other words, the bottom face 22 does not run off the point E3 outside in the horizontal direction. Accordingly, accumulation of the air is prevented.

Maximum diameter D2 of the second side wall face 20 is preferably 0.60 times or more and 0.95 times or less greater than the diameter D1 of the dimple 8*t*. When the diameter D2 is less than the above range, contributing rate of the second side wall face 20 or the bottom face 22 to the dimple effect may become insufficient. In this respect, the diameter D2 is more preferably equal to or more than 0.70 times, and particularly preferably equal to or more than 0.75 times greater than the diameter D1. When the diameter D2 is beyond the above range, contributing rate of first side wall face 18 to the dimple effect may become insufficient. In this respect, the diameter D2 is more preferably equal to or less than 0.93 times, and particularly preferably equal to or less than 0.90 times greater than the diameter D1.

Maximum diameter D3 of the bottom face 22 is preferably 0.60 times or more and 0.95 times or less greater than the diameter D2. When the diameter D3 is less than the above range, contributing rate of the bottom face 22 to the dimple effect may become insufficient. In this respect, the diameter D3 is more preferably equal to or more than 0.70 times, and particularly preferably equal to or more than 0.75 times greater than the diameter D2. When the diameter D3 is beyond the above range, contributing rate of second side wall face 20 to the dimple effect may become insufficient. In this respect, the diameter D3 is more preferably equal to or less than 0.93 times, and particularly preferably equal to or less than 0.90 times greater than the diameter D2.

What is indicated by a both-oriented arrowhead d1 in FIG. 5 is the depth of the first side wall face 18; what is indicated by a both-oriented arrowhead d2 is the depth of the second side wall face 20; and what is indicated by a both-oriented arrowhead d3 is the depth of the bottom face 22. Sum total of the depth d1, depth d2 and the depth d3 is the depth d of the dimple 8*t*.

The depth d1 of the first side wall face 18 is preferably 0.10 times or more and 0.50 times or less greater than the depth d of the dimple 8*t*. When the depth d1 is less than the above range, contributing rate of the first side wall face 18 to the dimple effect may become insufficient. In this respect, the depth d1 is more preferably equal to or more than 0.15 times, and particularly preferably equal to or more than 0.20 times greater than the depth d. When the depth d1 is beyond the above range, contributing rate of the second side wall face 20 or the bottom face 22 to the dimple effect may become insufficient. In this respect, the depth d1 is more preferably equal to or less than 0.45 times, and particularly preferably equal to or less than 0.40 time greater than the depth d.

The depth d2 of the second side wall face 20 is preferably 0.10 times or more and 0.60 times or less greater than the depth d of the dimple 8*t*. When the depth d2 is less than the above range, contributing rate of the second side wall face 20 to the dimple effect may become insufficient. In this respect, the depth d2 is more preferably equal to or more than 0.15 times, and particularly preferably equal to or more than 0.20 times greater than the depth d. When the depth d2 is beyond the above range, contributing rate of the first side wall face 18 or the bottom face 22 to the dimple effect may become insufficient. In this respect, the depth d2 is more preferably equal to or less than 0.55 times, and particularly preferably equal to or less than 0.50 times greater than the depth d.

The depth d3 of the bottom face 22 is preferably 0.05 times or more and 0.50 times or less greater than the depth d of the dimple 8*t*. When the depth d3 is less than the above range, contributing rate of the bottom face 22 to the dimple effect may become insufficient. In this respect, the depth d3 is more preferably equal to or more than 0.10 times, and particularly preferably equal to or more than 0.15 times greater than the depth d. When the depth d3 is beyond the above range, contributing rate of the first side wall face 18 or the second side wall face 20 to the dimple effect may become insufficient. In this respect, the depth d3 is more preferably equal to or less than 0.45 times, and particularly preferably equal to or less than 0.40 times greater than the depth d.

Figure 6:
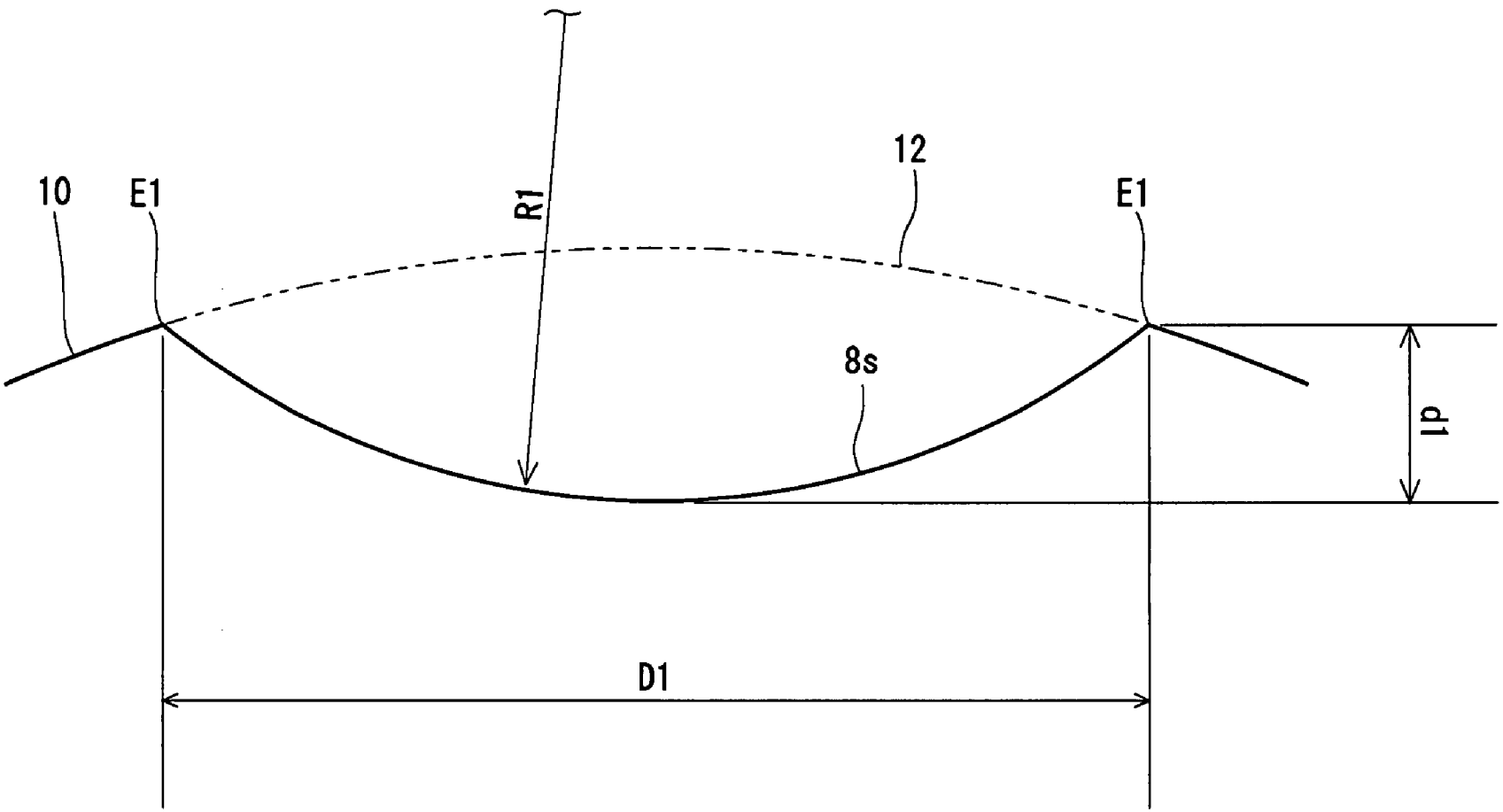
FIG. 6 is an enlarged cross-sectional view illustrating a part of the golf ball shown in FIG. 1.

FIG. 6 is an enlarged cross-sectional view illustrating a part of the golf ball 2 shown in FIG. 1. In this FIG. 6, a single radius dimple 8*s* is illustrated. This single radius dimple 8*s* has a surface having the cross-section that exhibits a circular arc. This single radius dimple 8*s* is continued to the land 10 at an edge E1. The edge E1 may be rounded. In FIG. 6, what is indicated by a both-oriented arrowhead D1 is the diameter; what is indicated by a both-oriented arrowhead d1 is the depth; and what is indicated by an arrow R1 is the curvature radius.

According to this golf ball 2, presence of the double radius dimples 8*d* and the triple radius dimples 8*t* admixed enables an extremely excellent dimple effect to be exerted. In addition, this golf ball 2 is excellent in the resilience performance as described above. In this golf ball 2, an excellent flight performance is achieved owing to the dimple effect and the excellent resilience performance. In light of the flight performance, it is necessary to set the proportion Pd of the double radius dimples 8*d* to the total number of the dimples 8 to be equal to or greater than 20%, and to set the proportion Pt of the triple radius dimples 8*t* to be equal to or greater than 50%. Proportion Ps of the single radius dimples 8*s* to the total number of the dimples 8 may be zero. In light of the flight performance, the proportion Pd is more preferably equal to or greater than 24%, and particularly preferably equal to or greater than 30%. In light of the scuff resistance, the proportion Pd is preferably equal to or less than 42%, more preferably equal to or less than 40%, and particularly preferably equal to or less than 38%. In light of the flight performance and scuff resistance, the proportion Pt is preferably equal to or greater than 55%. The proportion Pt is equal to or less than 80%.

Area s of the double radius dimple 8*d*, triple radius dimple 8*t* and single radius dimple 8*s* is an area of a region surrounded by the contour line when the center of the golf ball 2 is viewed at infinity. In instances of a circular dimple, the area s is calculated by the following formula:

$$s=(D1/2)^2*\pi.$$

In the golf ball 2 shown in FIG. 2 and FIG. 3, the area of the dimple A' is 20.43 $mm^2$; the area of the dimple B' is 19.63 $mm^2$; the area of the dimple C is 16.62 $mm^2$; the area of the dimple C' is 16.62 $mm^2$; the area of the dimple D is 15.90 $mm^2$; the area of the dimple D' is 15.90 $mm^2$; the area of the dimple E is 13.85 $mm^2$; the area of the dimple F" is 12.57 $mm^2$; and the area of the dimple G is 7.07 $mm^2$.

According to the present invention, ratio of total area of all the dimples 8 occupying the surface area of the phantom sphere 12 is referred to as an occupation ratio. From the standpoint that a sufficient dimple effect may be achieved, the occupation ratio is preferably equal to or greater than 70%, more preferably equal to or greater than 72%, and particularly preferably equal to or greater than 74%. The occupation ratio is preferably equal to or less than 90%. According to the golf ball 2 shown in FIG. 2 and FIG. 3, total area of the dimples 8 is 4662.2 $mm^2$. Because the surface area of the phantom sphere 12 of this golf ball 2 is 5728.0 $mm^2$, the occupation ratio is 81.4%.

According to the present invention, the term "dimple volume" means a volume of a part surrounded by a plane including the contour of the dimple 8, and the surface of the dimple 8. It is preferred that total volume of the dimples 8 is 250 $mm^3$ or greater and 400 $mm^3$ or less. When the total volume is less than the above range, a hopping trajectory may be provided. In this respect, the total volume is more preferably equal to or greater than 260 $mm^3$, and particularly preferably equal to or greater than 270 $mm^3$. When the total volume is beyond the above range, a dropping trajectory may be provided. In this respect, the total volume is more preferably equal to or less than 390 $mm^3$, and particularly preferably equal to or less than 380 $mm^3$.

A distance F between the deepest place of the dimple 8 and the phantom sphere 12 is preferably 0.10 mm or greater and 0.60 mm or less. When the distance F is less than the above range, a hopping trajectory may be provided. In this respect, the distance F is more preferably equal to or greater than 0.13 mm, and particularly preferably equal to or greater than 0.15 mm. When the distance F is beyond than the above range, a dropping trajectory may be provided. In this respect, the distance F is more preferably equal to or less than 0.55 mm, and particularly preferably equal to or less than 0.50 mm.

It is preferred that total number of the dimples 8 is 200 or greater and 500 or less. When the total number is less than the above range, the dimple effect maybe hardly exerted. In this respect, the total number is more preferably equal to or greater than 240, and particularly preferably equal to or greater than 260. When the total number is beyond the above range, the dimple effect may be hardly exerted due to small size of the individual dimples 8. In this respect, the total number is more preferably equal to or less than 480, and particularly preferably equal to or less than 460.

EXAMPLES

Example 1

A rubber composition was obtained by kneading 100 parts by weight of polybutadiene (trade name "BR-730", available from JSR Corporation), 24 parts by weight of zinc acrylate, 5 parts by weight of zinc oxide, an adequate amount of barium sulfate, 0.3 part by weight of bis(pentabromophenyl)disulfide and 0.6 part by weight of dicumyl peroxide. This rubber composition was placed into a mold having upper and lower mold half each having a hemispherical cavity, and heated at 170° C. for 30 minutes to obtain a core having a diameter of 37.1 mm. On the other hand, a type d resin composition shown in Table 2 below was prepared. The aforementioned core was placed into a mold, and the resin composition was injected around the core by injection molding to form a mid layer having a thickness of 1.0 mm. Further, a type g resin composition shown in Table 3 below was prepared. The aforementioned spherical body comprising the core and the mid layer was placed into a mold having numerous protrusions on the inside face, followed by injection of the resin composition around the spherical body by injection molding to form a cover having a thickness of 1.4 mm. Numerous dimples having a shape inverted from the shape of the protrusion were formed on the cover. Paint was applied on this cover to give a golf ball of Example 1 having a diameter of 42.7 mm and a weight of about 45.4 g. This golf ball had a total volume of the dimples of about 320 $mm^3$, and a surface area occupation ratio of about 81%. This golf ball has a dimple pattern of type III shown in Table 5 below. The dimple F" of this golf ball corresponds to tips of the hold pin or bent pin of the mold for the injection molding.

Examples 2 to 3 and Comparative Examples 1 to 5

In a similar manner to Example 1 except that specifications of the core, the mid layer, cover and the dimples were as listed in Table 6 and Table 7 below, golf balls of Examples 2 to 3 and Comparative Examples 1 to 5 were obtained. Details of the rubber composition of the core are listed in Table 1 below; details of the resin composition of the mid layer are listed in Table 2 below; details of the resin composition of the cover are listed in Table 3 below; and details of specifications of the dimples are listed in Table 4 and Table 5 below.

TABLE 1

Rubber composition of core

| Type | (part by weight) a | b |
|---|---|---|
| Polybutadiene | 100 | 100 |
| Zinc acrylate | 24 | 22 |
| Zinc oxide | 5 | 5 |
| Barium sulfate | adequate amount | adequate amount |
| Bis(pentabromophenyl)disulfide | 0.3 | 0.3 |
| Dicumyl peroxide | 0.6 | 0.6 |

TABLE 2

Resin composition of mid layer

| Type | (part by weight) c | d | e | f |
|---|---|---|---|---|
| Rabalon T3339C (material hardness: 7) | 25 | 40 | 35 | — |
| Surlyn 8945 (material hardness: 61) | 40 | 30 | 35 | — |
| Surlyn 9945 (material hardness: 60) | 35 | 30 | 30 | — |

TABLE 2-continued

Resin composition of mid layer

| Type | (part by weight) c | d | e | f |
|---|---|---|---|---|
| Elastollan ET880 (material hardness: 30) | — | — | — | 100 |
| Proportion Pst (%) | 25 | 40 | 35 | 0 |
| Proportion Pio (%) | 75 | 60 | 65 | 0 |
| Hardness (Shore D) | 54 | 42 | 47 | 30 |

TABLE 3

Resin composition of cover

| Type | (part by weight) g | h |
|---|---|---|
| Himilan 1555 | 60 | — |
| Himilan 1557 | 40 | — |
| Himilan 1605 | — | 55 |
| Himilan 1706 | — | 40 |
| Rabalon T3339C | — | 5 |
| Titanium dioxide | 2 | 2 |
| Barium sulfate | 2 | 2 |
| Hardness (Shore D) | 59 | 62 |

TABLE 4

Specifications of dimples

| | Kind | Number | Cross-sectional shape | D1 (mm) | D2 (mm) | D3 (mm) | d1 (mm) | d2 (mm) | d3 (mm) | d (mm) | F (mm) | R1 (mm) | R2 (mm) | R3 (mm) | Rx (mm) | V ($mm^3$) | D2/D1 | d1/d |
|---|---|---|---|---|---|---|---|---|---|---|---|---|---|---|---|---|---|---|
| Type I | A' | 24 | Double radius | 5.100 | 4.289 | — | 0.060 | 0.051 | — | 0.111 | 0.264 | 1.0 | 45.1 | — | 23.8 | 1.401 | 0.84 | 0.54 |
| | B' | 24 | Double radius | 5.000 | 4.202 | — | 0.061 | 0.050 | — | 0.110 | 0.257 | 1.0 | 44.6 | — | 22.9 | 1.346 | 0.84 | 0.55 |
| | C' | 60 | Double radius | 4.600 | 3.908 | — | 0.061 | 0.042 | — | 0.103 | 0.227 | 1.0 | 45.4 | — | 19.4 | 1.140 | 0.85 | 0.59 |
| | D' | 96 | Double radius | 4.500 | 3.829 | — | 0.061 | 0.041 | — | 0.102 | 0.221 | 1.0 | 44.3 | — | 18.5 | 1.091 | 0.85 | 0.60 |
| | E' | 60 | Double radius | 4.200 | 3.571 | — | 0.061 | 0.040 | — | 0.101 | 0.205 | 1.0 | 40.0 | — | 16.2 | 0.950 | 0.85 | 0.60 |
| | F" | 14 | Single radius | 4.000 | — | — | 0.137 | — | — | 0.137 | 0.231 | 14.7 | — | — | — | 0.862 | — | 1.00 |
| | G' | 24 | Double radius | 3.000 | 2.433 | — | 0.065 | 0.037 | — | 0.102 | 0.155 | 1.0 | 20.0 | — | 8.3 | 0.486 | 0.81 | 0.64 |
| Type II | A | 24 | Triple radius | 5.100 | 4.293 | 3.521 | 0.040 | 0.036 | 0.056 | 0.132 | 0.285 | 23.8 | 3.0 | 27.5 | 23.8 | 1.401 | 0.84 | 0.24 |
| | B | 24 | Triple radius | 5.000 | 4.209 | 3.519 | 0.040 | 0.036 | 0.054 | 0.130 | 0.277 | 22.9 | 3.0 | 28.5 | 22.9 | 1.346 | 0.84 | 0.24 |
| | C | 60 | Triple radius | 4.600 | 3.873 | 3.095 | 0.040 | 0.039 | 0.053 | 0.132 | 0.256 | 19.4 | 3.0 | 22.5 | 19.4 | 1.140 | 0.84 | 0.23 |
| | D | 96 | Triple radius | 4.500 | 3.789 | 3.036 | 0.040 | 0.039 | 0.052 | 0.131 | 0.250 | 18.5 | 3.0 | 22.3 | 18.5 | 1.091 | 0.84 | 0.24 |
| | E | 60 | Triple radius | 4.200 | 3.536 | 2.836 | 0.040 | 0.040 | 0.048 | 0.128 | 0.232 | 16.2 | 3.0 | 21.0 | 16.2 | 0.950 | 0.84 | 0.24 |
| | F" | 14 | Single radius | 4.000 | — | — | 0.137 | — | — | 0.137 | 0.231 | 14.7 | — | — | — | 0.862 | — | 1.00 |
| | G | 24 | Triple radius | 3.000 | 2.527 | 1.999 | 0.040 | 0.042 | 0.036 | 0.118 | 0.171 | 8.3 | 3.0 | 14.0 | 8.3 | 0.486 | 0.84 | 0.25 |

TABLE 5

Specifications of dimples

| | Kind | Number | Cross-sectional shape | D1 (mm) | D2 (mm) | D3 (mm) | d1 (mm) | d2 (mm) | d3 (mm) | d (mm) | F (mm) | R1 (mm) | R2 (mm) | R3 (mm) | Rx (mm) | V ($mm^3$) | D2/D1 | d1/d |
|---|---|---|---|---|---|---|---|---|---|---|---|---|---|---|---|---|---|---|
| Type III | A' | 24 | Double radius | 5.100 | 4.289 | — | 0.060 | 0.051 | — | 0.111 | 0.264 | 1.0 | 45.1 | — | 23.8 | 1.401 | 0.84 | 0.54 |
| | B' | 24 | Double radius | 5.000 | 4.202 | — | 0.061 | 0.050 | — | 0.110 | 0.257 | 1.0 | 44.6 | — | 22.9 | 1.346 | 0.84 | 0.55 |
| | C | 36 | Triple radius | 4.600 | 3.873 | 3.095 | 0.040 | 0.039 | 0.053 | 0.132 | 0.256 | 19.4 | 3.0 | 22.5 | 19.4 | 1.140 | 0.84 | 0.23 |
| | C' | 24 | Double radius | 4.600 | 3.908 | — | 0.061 | 0.042 | — | 0.103 | 0.227 | 1.0 | 45.4 | — | 19.4 | 1.140 | 0.85 | 0.59 |
| | D | 72 | Triple radius | 4.500 | 3.789 | 3.036 | 0.040 | 0.039 | 0.052 | 0.131 | 0.250 | 18.5 | 3.0 | 22.3 | 18.5 | 1.091 | 0.84 | 0.24 |
| | D' | 24 | Double radius | 4.500 | 3.829 | — | 0.061 | 0.041 | — | 0.102 | 0.221 | 1.0 | 44.3 | — | 18.5 | 1.091 | 0.85 | 0.60 |
| | E | 60 | Triple radius | 4.200 | 3.536 | 2.836 | 0.040 | 0.040 | 0.048 | 0.128 | 0.232 | 16.2 | 3.0 | 21.0 | 16.2 | 0.950 | 0.84 | 0.24 |
| | F" | 14 | Single radius | 4.000 | — | — | 0.137 | — | — | 0.137 | 0.231 | 14.7 | — | — | — | 0.862 | — | 1.00 |
| | G | 24 | Triple radius | 3.000 | 2.527 | 1.999 | 0.040 | 0.042 | 0.036 | 0.118 | 0.171 | 8.3 | 3.0 | 14.0 | 8.3 | 0.486 | 0.84 | 0.25 |
| Type IV | A | 24 | Triple radius | 5.100 | 4.293 | 3.521 | 0.040 | 0.036 | 0.056 | 0.132 | 0.285 | 23.8 | 3.0 | 27.5 | 23.8 | 1.401 | 0.84 | 0.24 |
| | B | 24 | Triple radius | 5.000 | 4.209 | 3.519 | 0.040 | 0.036 | 0.054 | 0.130 | 0.277 | 22.9 | 3.0 | 28.5 | 22.9 | 1.346 | 0.84 | 0.24 |
| | C' | 60 | Double radius | 4.600 | 3.908 | — | 0.061 | 0.042 | — | 0.103 | 0.227 | 1.0 | 45.4 | — | 19.4 | 1.140 | 0.85 | 0.59 |
| | D | 36 | Triple radius | 4.500 | 3.789 | 3.036 | 0.040 | 0.039 | 0.052 | 0.131 | 0.250 | 18.5 | 3.0 | 22.3 | 18.5 | 1.091 | 0.84 | 0.24 |
| | D' | 60 | Double radius | 4.500 | 3.829 | — | 0.061 | 0.041 | — | 0.102 | 0.221 | 1.0 | 44.3 | — | 18.5 | 1.091 | 0.85 | 0.60 |
| | E | 60 | Triple radius | 4.200 | 3.536 | 2.836 | 0.040 | 0.040 | 0.048 | 0.128 | 0.232 | 16.2 | 3.0 | 21.0 | 16.2 | 0.950 | 0.84 | 0.24 |
| | F" | 14 | Single radius | 4.000 | — | — | 0.137 | — | — | 0.137 | 0.231 | 14.7 | — | — | — | 0.862 | — | 1.00 |
| | G | 24 | Triple radius | 3.000 | 2.527 | 1.999 | 0.040 | 0.042 | 0.036 | 0.118 | 0.171 | 8.3 | 3.0 | 14.0 | 8.3 | 0.486 | 0.84 | 0.25 |

[Measurement of Resilience Coefficient]

To the golf ball was impacted a hollow cylinder made of aluminum of which weight being 200 g at a velocity of 40 m/s. Then, velocity of the hollow cylinder prior to and after the impact, and the velocity of the golf ball after the impact were measured to determine the resilience coefficient of the golf ball. Mean values obtained by 12 times measurement are shown in Table 6 and Table 7 below as indices on the basis of the resilience coefficient of the golf ball of Comparative Example 1 being presumed as 1.00.

[Travel Distance Test]

A driver with a metal head (trade name "XXIO", available from Sumitomo Rubber Industries, Ltd., shaft hardness: R, loft angle: 11°) was attached to a swing machine, available from True Temper Co. Then the golf ball was hit under the condition of to provide a head speed of 40 m/sec. Accordingly, the distance from the launching point to the point where the ball stopped was measured. Mean values of 12 times measurement are shown in Table 6 and Table 7 below.

[Evaluation of Feel at Impact]

Using a driver, the golf balls were hit by 10 golf players. Those which were evaluated as favorable in the feel at impact by 8 or more golf players were assigned "A"; those which were evaluated as favorable by from 6 to 7 golf players were assigned "B", those which were evaluated as favorable by from 4 to 5 golf players were assigned "C", and those which were evaluated as favorable by 3 or less golf players were assigned "D". The results are presented in Table 6 and Table 7 below.

[Evaluation of Scuff Resistance]

A sand wedge (trade name "XXIO", available from Sumitomo Rubber Industries, Ltd., shaft hardness: S, loft angle: 56°) was attached the swing machine described above. Then the golf ball was hit under the condition to provide a head speed of 21 m/sec. Accordingly, appearance of the golf ball was visually observed. Twenty golf balls were observed, and then rated into three ranks of from "A" to "C". The results are presented in Table 6 and Table 7 below. The rank "A" is most preferred.

TABLE 6

Results of evaluation

| | | Example 1 | Example 2 | Example 3 | Compara. example 1 |
|---|---|---|---|---|---|
| Core | Type | b | a | b | b |
| | Diameter (mm) | 37.9 | 38.3 | 37.9 | 36.7 |
| | Amount of compression deformation (mm) | 4.4 | 3.9 | 4.4 | 4.4 |
| Mid layer | Type | d | e | d | c |
| | Hardness Hm (Shore D) | 42 | 47 | 42 | 54 |
| | Thickness Tm (mm) | 1.0 | 1.0 | 1.0 | 1.6 |
| | Proportion Pst (%) | 40 | 35 | 40 | 25 |
| | Proportion Pio (%) | 60 | 65 | 60 | 75 |
| Cover | Type | g | h | g | g |
| | Hardness Hc | 59 | 62 | 59 | 59 |

TABLE 6-continued

Figure 7:
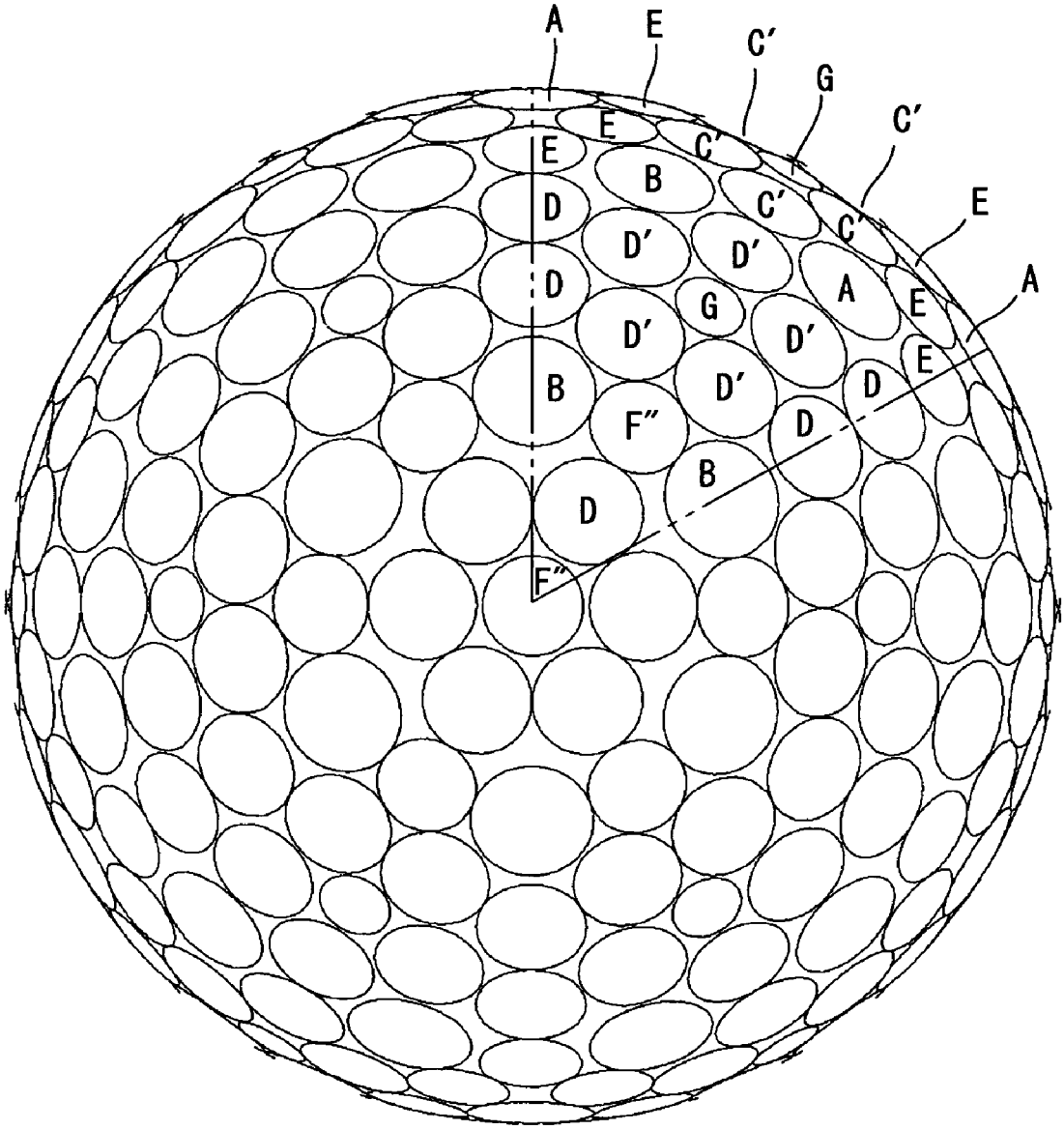
FIG. 7 is a plan view illustrating a golf ball according to Example 3 of the present invention.
Figure 8:
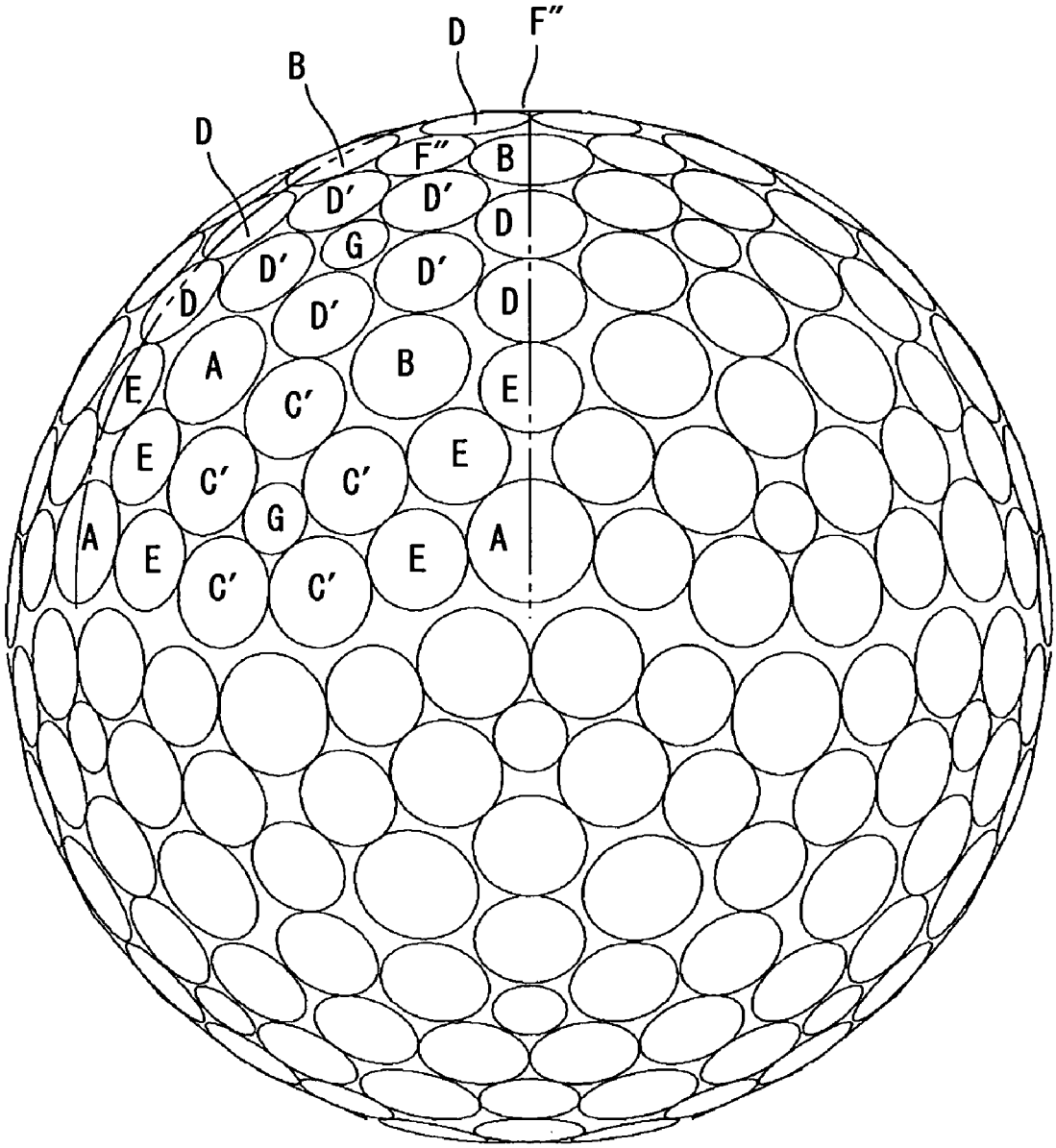
FIG. 8 is a front view illustrating the golf ball shown in FIG. 7.

| Results of evaluation | | Example 1 | Example 2 | Example 3 | Compara. example 1 |
|---|---|---|---|---|---|
| | (Shore D) | | | | |
| | Thickness Tc (mm) | 1.4 | 1.2 | 1.4 | 1.4 |
| Dimple | Type | III | III | IV | III |
| | Plan view | FIG. 2 | FIG. 2 | FIG. 7 | FIG. 2 |
| | Front view | FIG. 3 | FIG. 3 | FIG. 8 | FIG. 3 |
| | Proportion Pd (%) | 32 | 32 | 40 | 32 |
| | Proportion Pt (%) | 64 | 64 | 56 | 64 |
| | Proportion Ps (%) | 5 | 5 | 5 | 5 |
| Hc − Hm (Shore D) | | 17 | 15 | 17 | 5 |
| Tc/Tm | | 1.4 | 1.2 | 1.4 | 0.9 |
| Resilience coefficient (index) | | 1.01 | 1.03 | 1.01 | 1.00 |
| Travel distance (m) | | 194.0 | 196.0 | 196.0 | 193.0 |
| Scuff resistance | | A | A | B | A |
| Feel at impact | | A | A | A | C |

TABLE 7

Figure 9:
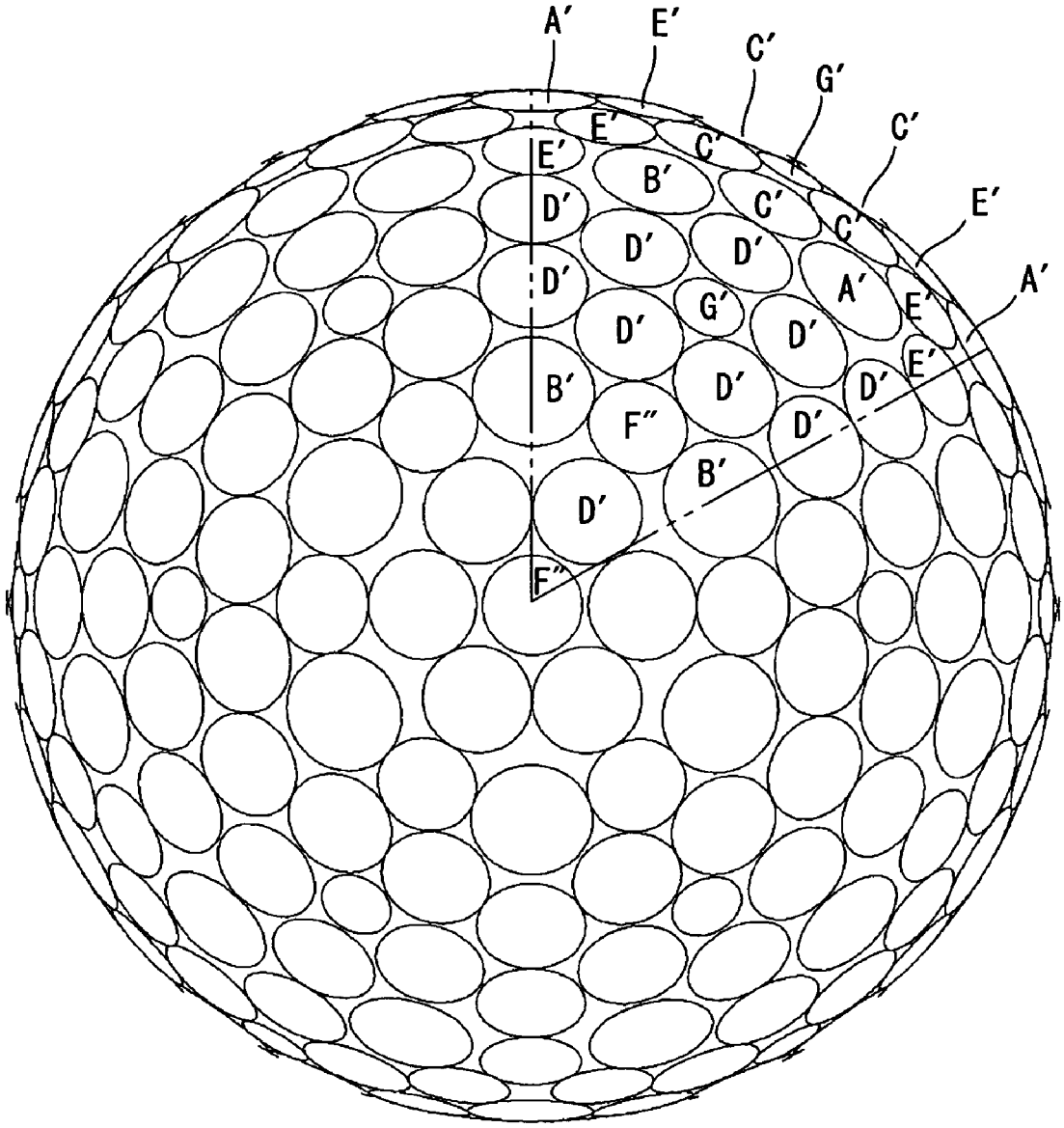
FIG. 9 is a plan view illustrating a golf ball according to Comparative Example 2.
Figure 10:
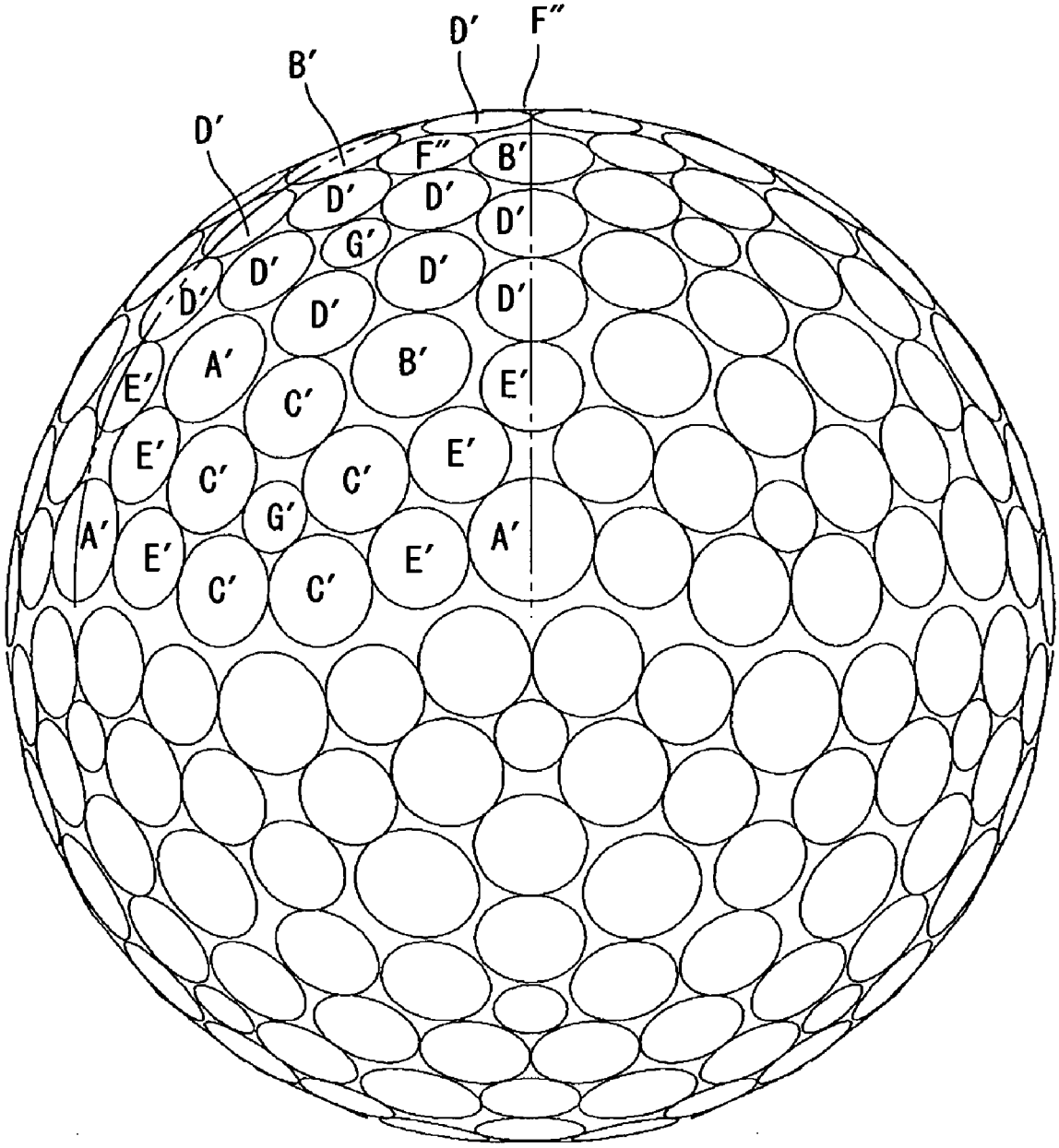
FIG. 10 is a front view illustrating the golf ball shown in FIG. 9.
Figure 11:
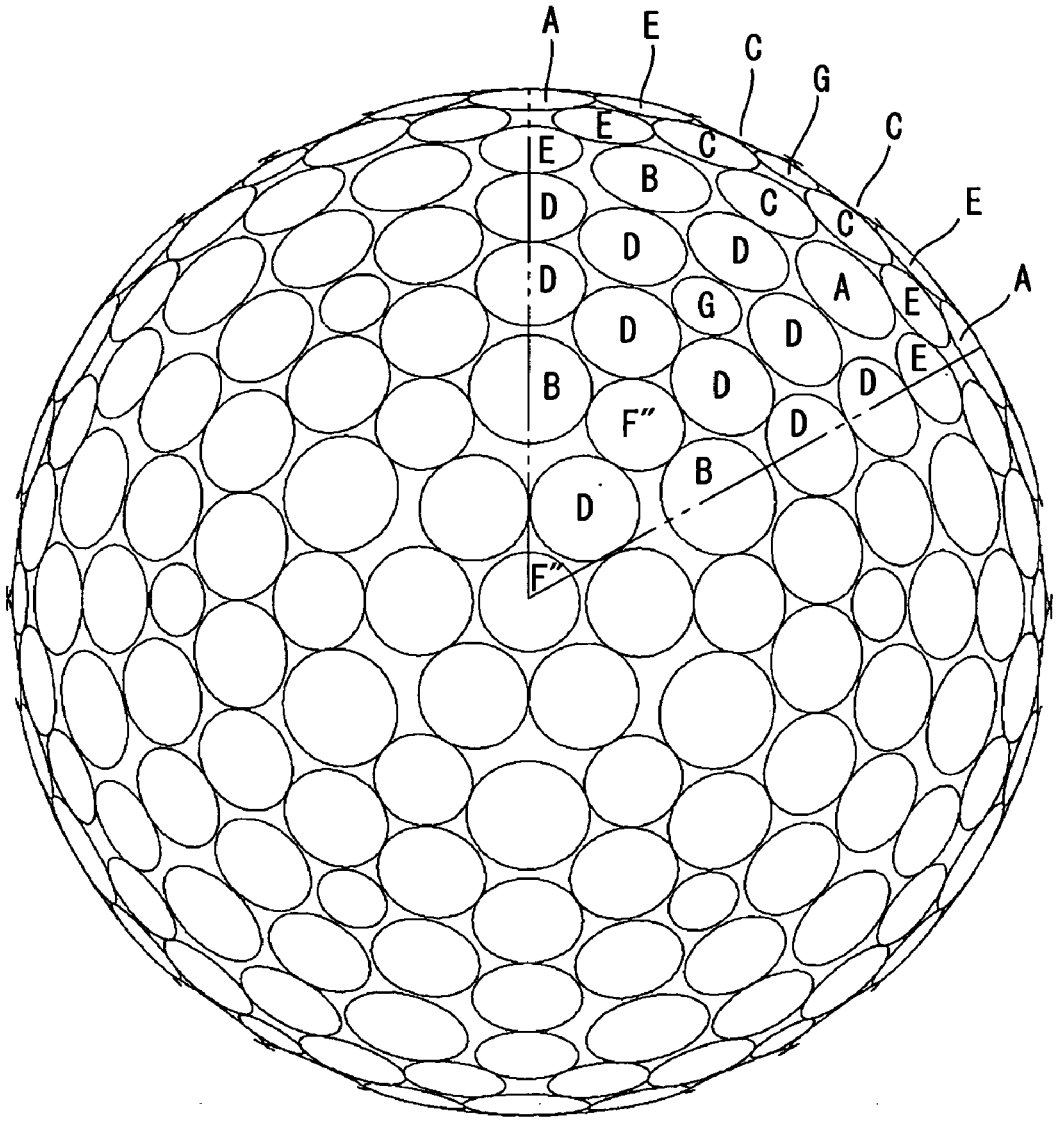
FIG. 11 is a plan view illustrating a golf ball according to Comparative Example 3.
Figure 12:
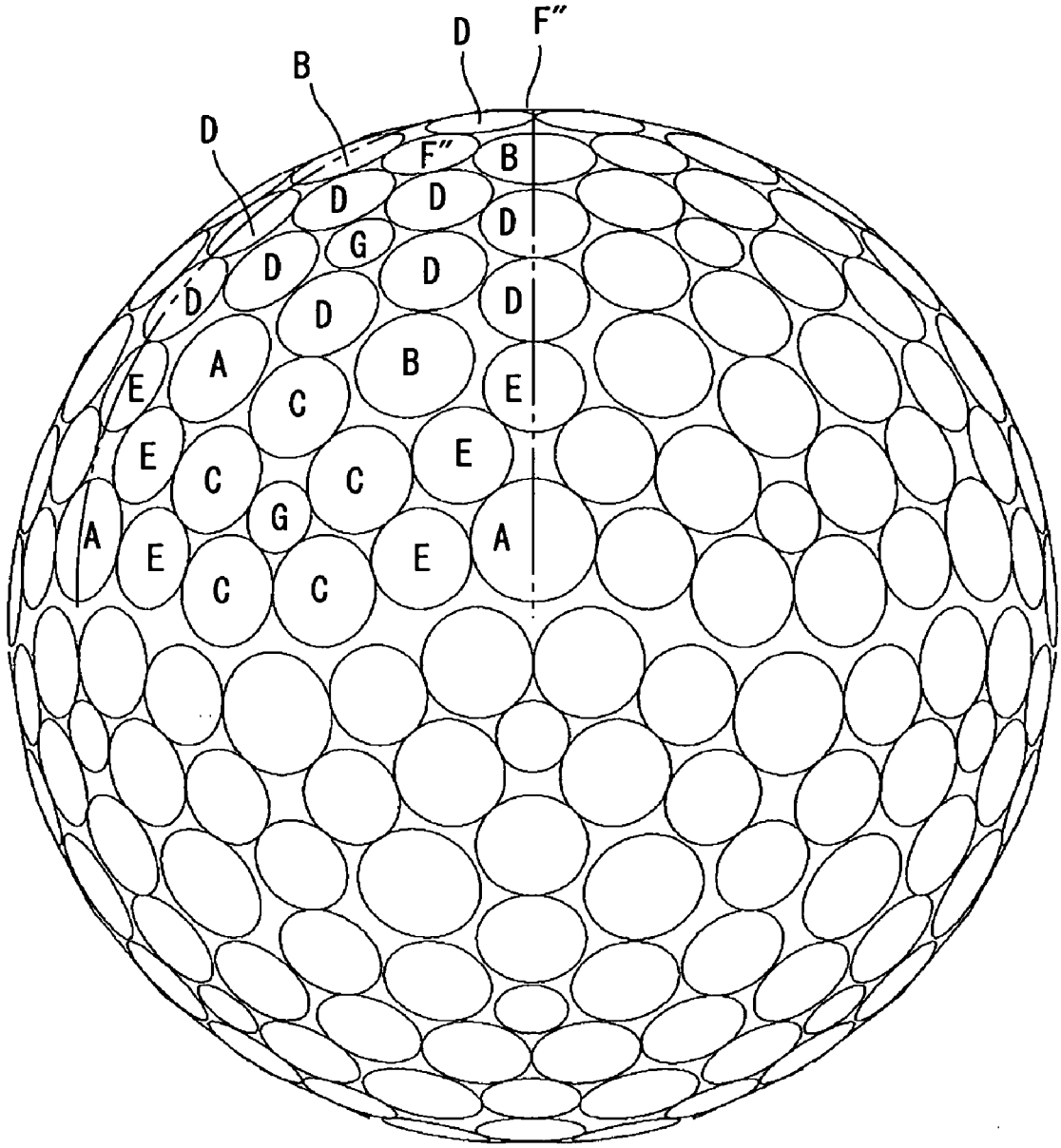
FIG. 12 is a front view illustrating the golf ball shown in FIG. 11.

| Results of evaluation | | Compara. example 2 | Compara. example 3 | Compara. example 4 | Compara. example 5 |
|---|---|---|---|---|---|
| Core | Type | b | b | a | b |
| | Diameter (mm) | 37.9 | 37.9 | 37.9 | 37.1 |
| | Amount of compression deformation (mm) | 4.4 | 4.4 | 3.9 | 4.4 |
| Mid layer | Type | d | d | f | e |
| | Hardness Hm (Shore D) | 42 | 42 | 30 | 47 |
| | Thickness Tm (mm) | 1.0 | 1.0 | 1.0 | 1.0 |
| | Proportion Pst (%) | 40 | 40 | 0 | 35 |
| | Proportion Pio (%) | 60 | 60 | 0 | 65 |
| Cover | Type | g | g | h | h |
| | Hardness Hc (Shore D) | 59 | 59 | 62 | 62 |
| | Thickness Tc (mm) | 1.4 | 1.4 | 1.4 | 1.8 |
| Dimple | Type | I | II | III | III |
| | Plan view | FIG. 9 | FIG. 11 | FIG. 2 | FIG. 2 |
| | Front view | FIG. 10 | FIG. 12 | FIG. 3 | FIG. 3 |
| | Proportion Pd (%) | 95 | 0 | 32 | 32 |
| | Proportion Pt (%) | 0 | 95 | 64 | 64 |
| | Proportion Ps (%) | 5 | 5 | 5 | 5 |
| Hc − Hm (Shore D) | | 17 | 17 | 32 | 15 |
| Tc/Tm | | 1.4 | 1.4 | 1.4 | 1.8 |
| Resilience coefficient (index) | | 1.01 | 1.01 | 0.98 | 1.02 |
| Travel distance (m) | | 193.5 | 193.5 | 193.0 | 194.5 |
| Scuff resistance | | D | A | A | A |
| Feel at impact | | A | A | B | C |

As shown in Table 6 and Table 7, the golf balls of Examples are excellent in the flight performance, feel at impact and scuff resistance. Therefore, advantages of the present invention are clearly suggested by these results of evaluation.

The present invention is applicable to golf balls which may be used in playing on a golf course, as well as golf balls which may be used on a driving range.

The foregoing description is just for illustrative examples, therefore, various modifications can be made in the scope without departing from the principles of the present invention.

What is claimed is:

1. A golf ball comprising a core, a mid layer and a cover, wherein said mid layer comprises 20% by weight or greater and 60% by weight or less of a styrene block-containing thermoplastic elastomer having a material hardness of less than 10, and 40% by weight or greater and 80% by weight or less of an ethylene-(meth)acrylic acid copolymer-based ionomer resin having a material hardness of 50 or greater and 70 or less, said mid layer has a hardness of 35 or greater and 50 or less, and a thickness of equal to or less than 1.2 mm, said cover has a hardness of equal to or greater than 55, and a thickness of equal to or less than 1.5 mm, said golf ball has numerous double radius dimples and numerous triple radius dimples on the surface thereof, said double radius dimple comprises a first side wall face having a curvature radius R1, and a bottom face having a curvature radius R2 that is 5 times or more and 55 times or less greater than the curvature radius R1 and being positioned on the bottom side of the first side wall face, said triple radius dimple comprises a first side wall face having a curvature radius R1 that is equal to or greater than the phantom curvature radius Rx, a second side wall face being positioned on the bottom side of the first side wall face and having a curvature radius R2 that is smaller than the phantom curvature radius Rx, and a bottom face being positioned on the bottom side of the second side wall face and having a curvature radius R3 that is equal to or greater than the phantom curvature radius Rx, a proportion of the number of the double radius dimples in total number of the dimples is 20% or greater and 42% or less, and a proportion of the number of the triple radius dimples in total number of the dimples is equal to or greater than 50%.

2. The golf ball according to claim 1 wherein the depth of the first side wall face is 0.20 times or more and 0.70 times or less greater than the depth of the dimple in said double radius dimple.

3. The golf ball according to claim 1 wherein the maximum diameter of the bottom face is 0.60 times or more and 0.95 times or less greater than the diameter of the dimple in said double radius dimple.

4. The golf ball according to claim 1 wherein the depth of the first side wall face is 0.10 times or more and 0.50 times or less greater than the depth of the dimple in said triple radius dimple.

5. The golf ball according to claim 1 wherein the maximum diameter of the second side wall face is 0.60 times or more and 0.95 times or less greater than the diameter of the dimple in said triple radius dimple.

6. The golf ball according to claim 1 wherein the first side wall face and the bottom face of said double radius dimple, and the first side wall face, the second side wall face and the bottom face of said triple radius dimple are convex downward.

7. The golf ball according to claim 1 wherein the ratio (Tc/Tm) of the thickness Tc of the cover to the thickness Tm of the mid layer is 1.0 or greater and 2.0 or less.

* * * * *